US008342347B2

(12) United States Patent
Hay

(10) Patent No.: US 8,342,347 B2
(45) Date of Patent: Jan. 1, 2013

(54) COLLAPSIBLE CONTAINER WITH A SLIDING LOCK FEATURE

(75) Inventor: Henry F. Hay, Calgary (CA)

(73) Assignee: Nova Chemicals (International) S.A., Fribourg (CH)

( * ) Notice: Subject to any disclaimer, the term of this patent is extended or adjusted under 35 U.S.C. 154(b) by 324 days.

(21) Appl. No.: 12/587,530

(22) Filed: Oct. 8, 2009

(65) Prior Publication Data

US 2011/0084069 A1 Apr. 14, 2011

(51) Int. Cl.
*B65D 6/10* (2006.01)
*B65D 6/22* (2006.01)
*B65D 6/26* (2006.01)

(52) U.S. Cl. ..... 220/4.28; 16/352; 220/7; 220/617; 220/671; 220/675; 220/693; 312/258

(58) Field of Classification Search ..... 220/6, 7, 220/4.28, 617, 618, 621, 642, 693, 4.34, 220/684, 669, 671, 675; 312/258; 16/327, 16/328, 352
See application file for complete search history.

(56) References Cited

U.S. PATENT DOCUMENTS

| | | | | |
|---|---|---|---|---|
| 2,747,276 | A * | 5/1956 | Yatsko | 30/132 |
| 2,868,407 | A * | 1/1959 | Woodcock | 220/7 |
| 3,570,698 | A | 3/1971 | Dougherty | |
| 3,796,342 | A | 3/1974 | Sanders et al. | |
| 3,870,185 | A | 3/1975 | Sanders et al. | |
| 3,985,258 | A | 10/1976 | Quigley et al. | |
| 4,214,669 | A | 7/1980 | McQuiston | |
| 4,223,788 | A * | 9/1980 | Jaeger et al. | 206/468 |
| 4,402,397 | A * | 9/1983 | Spence | 220/4.28 |
| 4,577,772 | A | 3/1986 | Bigliardi | |
| 4,630,746 | A | 12/1986 | Fortenberry | |
| 4,693,386 | A | 9/1987 | Hughes et al. | |
| 4,848,618 | A | 7/1989 | Yuan et al. | |
| 5,038,953 | A | 8/1991 | Radar | |
| 5,111,938 | A * | 5/1992 | Soprano et al. | 206/386 |
| 5,190,179 | A | 3/1993 | Richter et al. | |
| 5,253,763 | A | 10/1993 | Kirkley et al. | |
| 5,474,197 | A | 12/1995 | Hillis et al. | |
| 5,671,855 | A | 9/1997 | Norman, Jr. et al. | |
| 5,904,262 | A * | 5/1999 | Coppi | 220/7 |
| 6,484,898 | B2 | 11/2002 | Hillis et al. | |
| 6,631,821 | B2 | 10/2003 | Vourganas | |
| 6,726,046 | B2 | 4/2004 | Orset | |
| 6,913,161 | B2 | 7/2005 | Schafer | |
| 7,137,522 | B2 | 11/2006 | Dubois | |
| 7,175,040 | B2 | 2/2007 | Lorenz et al. | |
| 2005/0098556 | A1 * | 5/2005 | Kellerer | 220/7 |
| 2006/0237456 | A1 | 10/2006 | McDade | |
| 2008/0017638 | A1 * | 1/2008 | Bradford | 220/6 |
| 2008/0179321 | A1 * | 7/2008 | Stout et al. | 220/6 |
| 2009/0014445 | A1 * | 1/2009 | Hay et al. | 220/6 |

FOREIGN PATENT DOCUMENTS

| | | |
|---|---|---|
| CA | 1159379 | 12/1983 |
| CA | 1333055 | 11/1994 |

* cited by examiner

*Primary Examiner* — Mickey Yu
*Assistant Examiner* — Niki Eloshway
(74) *Attorney, Agent, or Firm* — Kenneth H Johnson

(57) ABSTRACT

A collapsible, portable container having a roof, a base, two foldable end walls and two removable side walls. The container is collapsed by removing the side walls and inwardly folding the end walls to draw the roof closer to the base. A slide lock feature is present which alternatively allows or prevents the inward folding of the container end walls.

14 Claims, 34 Drawing Sheets

COLLAPSIBLE CONTAINER WITH A SLIDING LOCK FEATURE

FIELD OF THE INVENTION

The current invention is directed to collapsible storage containers, in particular to containers made having one or more locking features which allow or prevent the collapsing of the container.

BACKGROUND OF THE INVENTION

Collapsible shipping and storage containers are well known in the art. Collapsibility is desirable in order to minimize the space requirements of the container when it is empty and not in use.

Collapsible containers typically include pivotally attached or foldable side or end walls, a base and optionally a roof. Generally, shipping containers are constructed from wood, metal and plastic parts.

Metal containers are durable with high load bearing capacities, but are heavy. A metal container having inwardly folding horizontally hinged side walls is disclosed in U.S. Pat. No. 5,190,179. The container also has end walls that pivot to within the container where they are stored when the container is collapsed. The metal container contains fork lift tines to allow for its movement when collapsed or erected. Other metal containers having similar features are disclosed in U.S. Pat. Nos. 4,577,772; 3,570,698; 4,848,618 and 4,214,669.

A plywood container having foldable side walls and a collapsible design is disclosed in U.S. Pat. No. 5,253,763.

Plastic containers are lighter than metal containers, are generally not as durable and are typically much smaller in size due to a reduced load bearing capacity. As a result, the storage capacity of plastic containers can be limited. For example, a collapsible shipping container made of plastic is described in U.S. Pat. No. 4,630,746. Each part of the container has a "meshed" structure made by injection molding. The container has two opposing side walls that are inwardly foldable along a vertically hinged axis. In contrast, U.S. Pat. No. 3,870,185 teaches a collapsible plastic container having side walls that are inwardly foldable along a horizontally hinged axis. Further plastic containers having a horizontally hinged collapsible side wall or end wall are disclosed in U.S. Pat. Nos. 3,796,342; 5,038,953; 6,726,046; 6,913,161; 7,137,522; 7,175,040 and CA Pat No. 1,333,055. In addition, U.S. Pat App. No. 2006/0237456 teaches that a latch means can be employed to secure the panels of an inwardly folding side wall in a vertical or erect position.

To impart rigidity and strength to plastic components used in containers, the components are often ribbed or open framework structures, in which flanged sections may be arranged perpendicularly to the vertical or load bearing axis (see U.S. Pat. Nos. 3,985,258; 5,474,197 and 6,484,898).

Commonly owned U.S. patent application Ser. No. 11/827,311, describes the use of twinned wall plastic components to impart high structural strength and rigidity to a collapsible storage container, while at the same time minimizing container weight. The container has an integral roof and end walls which fold inwardly along a horizontal axis and serves as a collapsible storage system. Also, elongate concave cutouts are taught which can be used to increase the flexural rigidity of the wall components.

U.S. Pat. No. 6,631,821, describes an open topped knock down bin, which comprises twinned wall (or "double wall") components. The double wall components consist of a base, two ends walls and two side walls and are preferably composed of rotomolded plastic. Although the knock down bin can be disassembled, it is not strictly speaking collapsible. For example, none of the walls are pivotally attached to the base in such a way as to facilitate rapid collapsing of the bin. Instead, the bin has a network of horizontally and vertically penetrating reinforcing bars to hold the bin corners together and which must be removed prior to deconstructing the bin. Finally, the bin has vented walls and is not weather proof.

U.S. Pat. No. 4,693,386 and CA Pat. No 1,159,379 each describe a collapsible shipping container made out of twin walled rotomolded plastic components. In each case the containers have four side walls and a base but do not have an integral roof structure. All side walls are pivotally attached to the base. Also, the containers are not weather proof.

In light of the above, there remains a need for weatherproof collapsible containers having good load bearing properties and high storage capacity but without the added weight or corrosion problems of metal component parts.

SUMMARY OF THE INVENTION

The present invention provides an improved version of prior art collapsible containers.

The present invention provides a collapsible container that is relatively lightweight, has a high load bearing capacity and has one or more locking features which allow or prevent the collapsing of the container.

The current invention provides a collapsible container comprising: a roof; a base; two opposing end walls, each end wall comprising an upper and a lower end wall panel pivotally attached to the roof and the base respectively, the upper end wall panel being horizontally pivotally attached to the lower end wall panel to permit inward folding of each end wall; two opposing removable side walls fitting between the roof and the base; the end walls and the side walls being a twinned wall structure defined by inner and outer wall members made of plastic; whereby the container is collapsible by removing the side walls and inwardly folding the end walls to draw the roof toward the base; and where a slide lock is present which prevents the inward folding of said end walls after said side walls have been removed.

In an embodiment of the invention the slide lock comprises a partially tubular component which engages the upper and lower end wall panels of an end wall and which slides between an open position and a closed position. The slide lock rides on a track molded within and along a common edge of the upper and lower end wall panels and which traverses a horizontal axis along which the upper and lower end wall panels are pivotally attached to one another. When in the open position, the slide lock resides on a portion of the track entirely within the upper end wall panel or entirely within the lower end wall panel. When in a locked position, the slide lock will traverse the horizontal axis along which the upper and lower end wall panels are pivotally attached to one another, thereby preventing pivoting motion about the horizontal axis. A slide lock can be present on one lateral edge of each end wall, on both lateral edges of each end wall or on one lateral edge of one end wall.

Provided is a collapsible container comprising: a roof; a base; two opposing end walls, each end wall comprising an upper and a lower end wall panel pivotally attached to said roof and said base respectively, said upper end wall panel being horizontally pivotally attached to said lower end wall panel to permit inward folding of each of said end walls; two opposing removable side walls fitting between said roof and said base; at least one slide lock; each slide lock riding along common lateral edges of said upper and lower end wall panels, wherein said slide lock prevents the inward folding of said end walls when in a locked position and allows the inward folding of said ends walls when in an unlocked position; the end walls and the side walls being a twinned wall structure defined by inner and outer wall members made of plastic; whereby the container is collapsible by removing said side walls and, with said slide lock in said unlocked position, inwardly folding said end walls to draw said roof closer to said base.

In an embodiment of the invention, the side walls are partitioned into at least two removable side wall panels.

In an embodiment of the invention, each of the side wall panels engage the roof and the base by complimentary upper and lower tongue and groove means respectively.

In an embodiment of the invention, adjacent edges of the end walls and the side walls engage each other through mating tongue and groove formations.

In an embodiment of the invention, each tongue and groove means between the side wall panels and the roof has at least one section dimensioned to loosely engage a side wall panel aligned with the section, so that the side wall panels can be removed from the container when aligned with at least one section so dimensioned.

In an embodiment of the invention the container has a locking means that prevents removal of a side wall panel that is aligned with a section dimensioned to loosely engage a side wall panel.

In an embodiment of the invention, the base has a recessed area that holds each of the side wall panels when the container is collapsed.

In an embodiment of the invention, each of the side walls comprise first, second and third sequentially adjacent side wall panels.

In an embodiment of the invention, each upper tongue and groove means has one or more sections dimensioned to loosely engage the first, second and third side wall panels, so that the first, second and third side wall panels can be removed from the container when aligned with the one or more sections.

In an embodiment of the invention, the container further comprises a locking means which prevents removal of the first, second or third side wall panels when aligned with the one or more sections.

In an embodiment of the invention, the upper end wall panels are pivotally attached to end skirting walls extending downwardly from the roof.

In an embodiment of the invention, the lower end wall panels are pivotally attached to end retaining walls extending upwardly from the base.

In an embodiment of the invention, the end walls, the end retaining walls and the side walls have, along one lateral edge, a corner extension.

In an embodiment of the invention, the corner extension on the end walls and the end retaining walls engages an adjacent edge of the side walls by a vertical tongue and groove means and the corner extension on the side walls engages an adjacent edge of the end walls and the end retaining walls by a vertical tongue and groove means.

In an embodiment of the invention, the third side wall panel has attached to an upper edge, a rotatable cam lock, the cam lock allowing or preventing removal of the third side wall panel from the container.

In an embodiment of the invention, at least one of the side walls and/or end walls has at least one concave indentation, the concave indentation forming an internal arch between said inner and outer wall members.

In an embodiment of the invention, the base has depending tine slots.

In an embodiment of the invention, the roof has protrusions complimentary to said tine slots so that a plurality of containers can be stacked one on top of the other without slippage.

In an embodiment of the invention, the side walls and the end walls are rotomolded plastic components.

The inventive containers are collapsible to minimize space requirements during transport and are easily moved without requiring specialized equipment.

The inventive containers are weatherproof and stackable when collapsed or erected.

DETAILED DESCRIPTION

The current invention describes collapsible containers which are strong and durable and have several locking features, including a sliding lock feature that prevents the inward folding of collapsible end walls.

In the current invention, the use of the terms "end wall" and "side wall" is arbitrary and is used only to distinguish one set of opposing container walls from the other. It will be recognized by a person skilled in the art that the side walls can be designated as the end walls and vice versa and that the side walls can be the same length as the end walls, or they may be longer or shorter than the end walls. However, for a rectangular container, the term "end walls" will be used to describe the relatively short walls, while the term "side walls" will be used to describe the relatively long walls as is conventional in the art.

The terms "engaging", "mating", "engaging edges" or "mating edges" includes adjacent surfaces or edges having complimentary tongue and groove means, interlocking edges, interlocking offset edges, abutting offset edges and the like, but does not include fully abutting (i.e. flush) parallel edges having no overlapping regions.

The term "removable" is meant to encompass container components that are in their entirety removable from the container without an attachment point to any other component of the container. In contrast, the term "integral" is meant to encompass container components that have at least one point of attachment to at least one other component of the container regardless of their orientation or configuration.

Figure 1A:
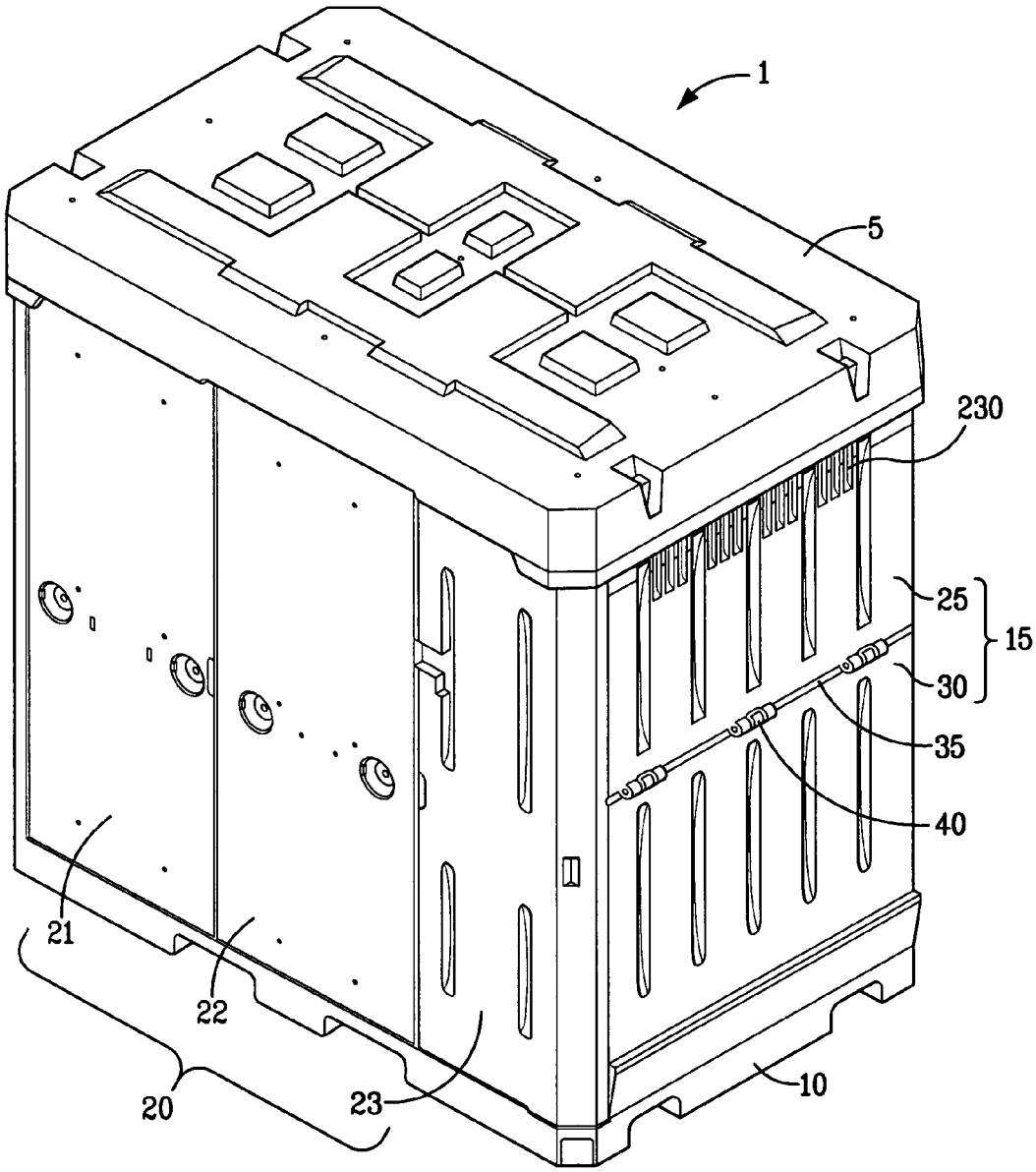
FIG. 1A shows a perspective view of an embodiment of the current invention.
Figure 1B:
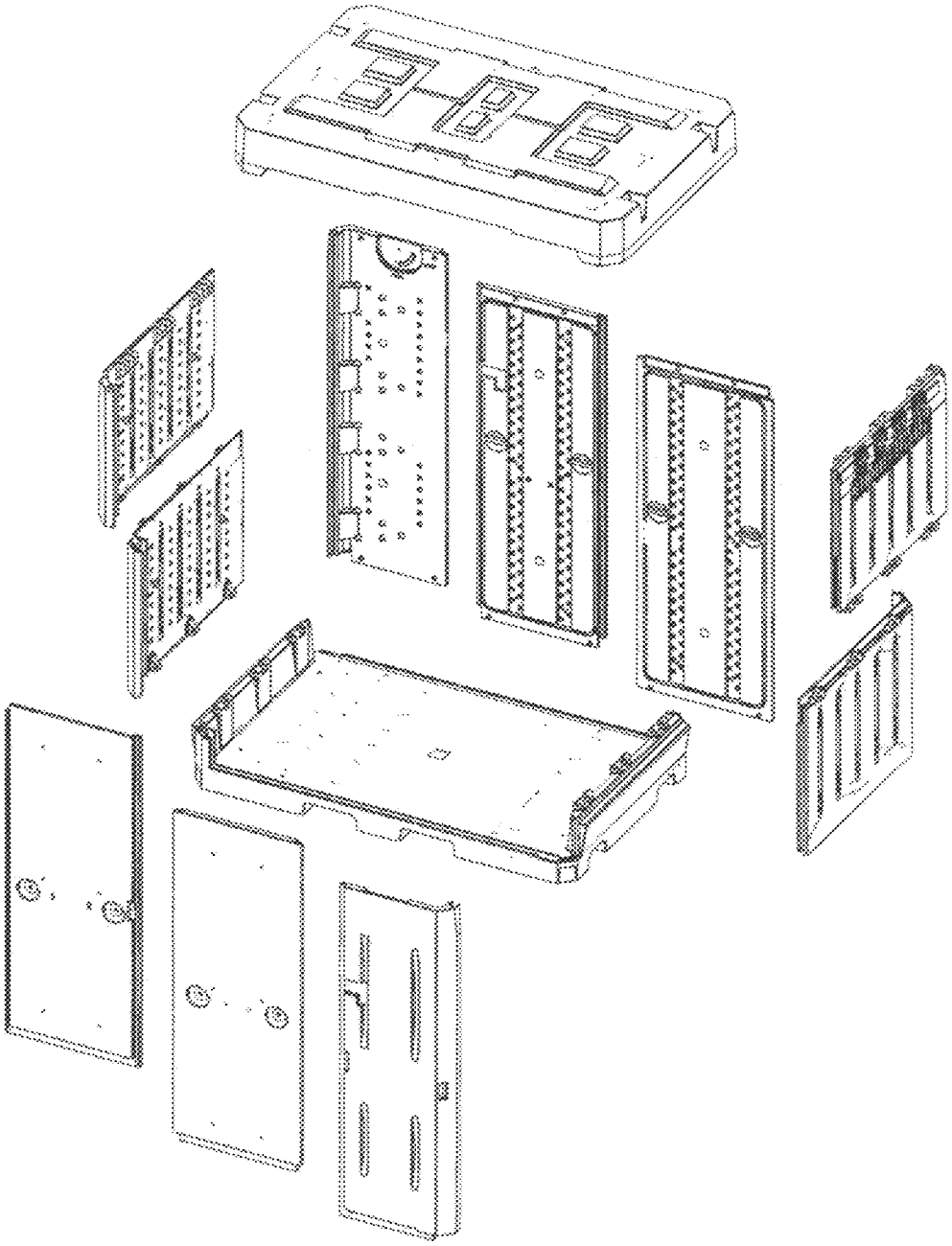
FIG. 1B shows an exploded perspective view of an embodiment of the invention.

FIGS. 1A and 1B show an embodiment of the current invention. The container 1 has a roof 5, a base 10, two opposing integral end walls 15, and two opposing removable side walls, 20. The opposing end walls are each comprised of an upper end wall panel 25 and a lower end wall panel 30 pivotally attached to the roof 5 and the base 10 respectively. The upper end wall panels 25 are pivotally attached to lower end wall panels 30 along a horizontal axis 35 by hinges 40. Preferably, the axis 35 extends horizontally across the vertical midpoint or near the centre of the end walls 15.

Figure 2:
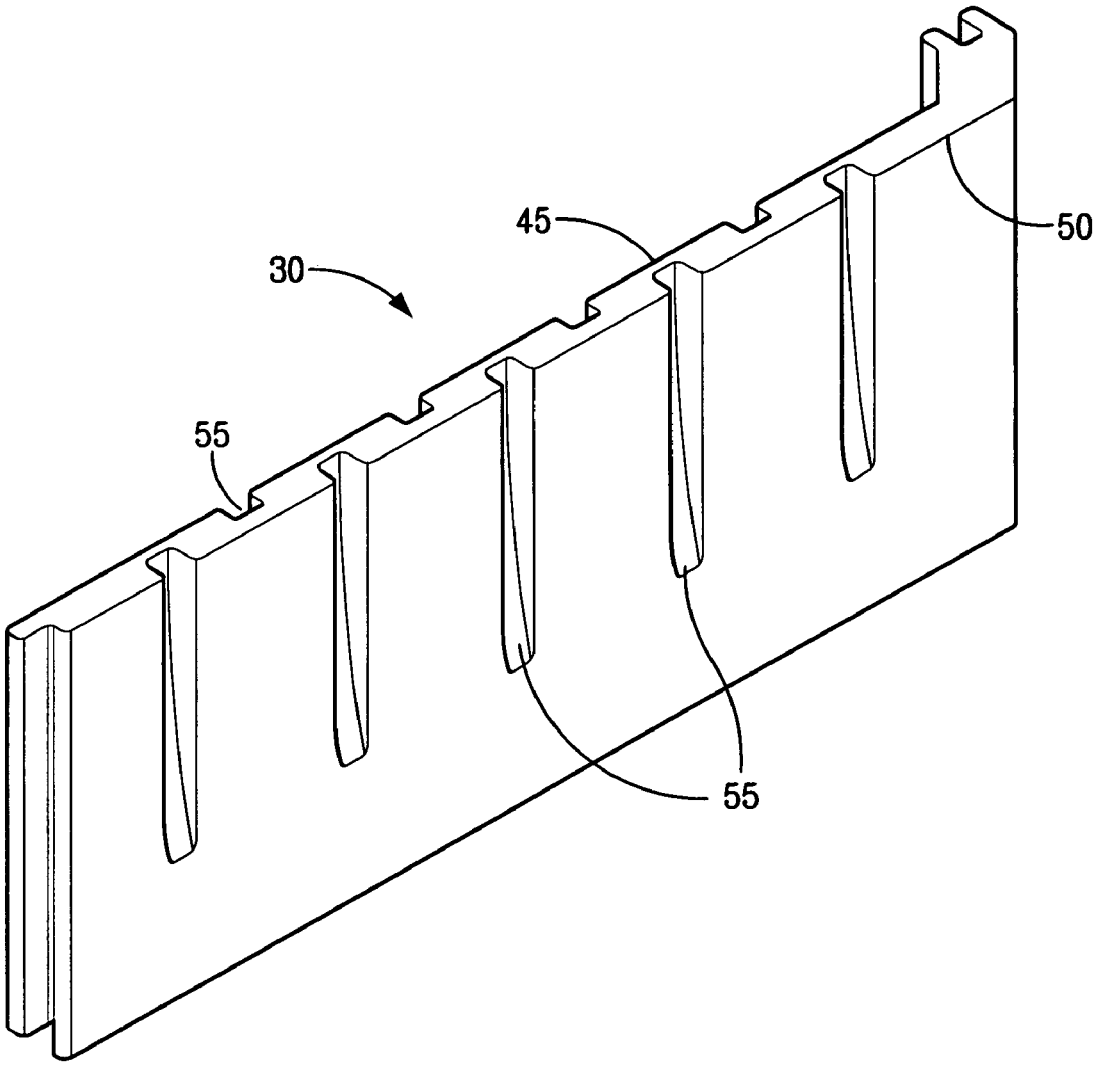
FIG. 2 shows a cross sectional perspective view of a lower end wall panel in an embodiment of the invention.

In a preferred embodiment the ends walls and the side walls are plastic components having a twinned wall structure defined by an inner wall member 45 and an outer wall member 50. The roof and base may also be twinned wall structures made of plastic. The twinned wall structure has a void space between inner and outer wall members 45 and 50 respectively as shown in FIG. 2 for an end wall panel. A person skilled in the art will recognize that similar twinned wall structures having an inner wall member 45 and an outer wall member 50 can be drawn for each of the end walls, the side walls, the base and the roof. The distinction between inner wall member 45 and outer wall member 50 is arbitrary, but for convenience, the inner wall member is the wall member that faces the inside of the container when erected, and the outer wall member is the wall member that faces the outside of the container when erected.

In an embodiment of the present invention, each of the end walls and side walls are rotomolded plastic components. The roof and base may also be rotomolded plastic components. The end walls, the side walls, the base and the roof may be rotomolded plastic components independently rotomolded from one or more thermoplastic polyolefins, such as, but not limited to, polyethylene.

Rotomolding techniques are well known in the art and are particularly well suited to the production of large or hollow plastic parts having complex shapes. The plastic used can be any plastic suitable for rotomolding applications and will preferably have some inherent resiliency to cracking, flexing, stretching and the like. By way of a non-limiting example only, the plastic used may be a thermoplastic such as an ethylene homopolymer or an ethylene/alpha olefin copolymer. In the present invention the term "polyethylene" includes both ethylene homopolymers and copolymers of ethylene and alpha olefins.

In an embodiment of the present invention, each of the base, end walls, side walls and roof are plastic components independently rotomolded from one or more thermoplastic polyolefins, such as, but not limited to, polyethylene. For example, the base, end walls, side walls and roof may be fabricated from rotational molding methods using polyethylene resins, such as, but not limited to, one or more SURPASS™ polyethylene resins available from NOVA Chemicals Inc.

Figure 3:
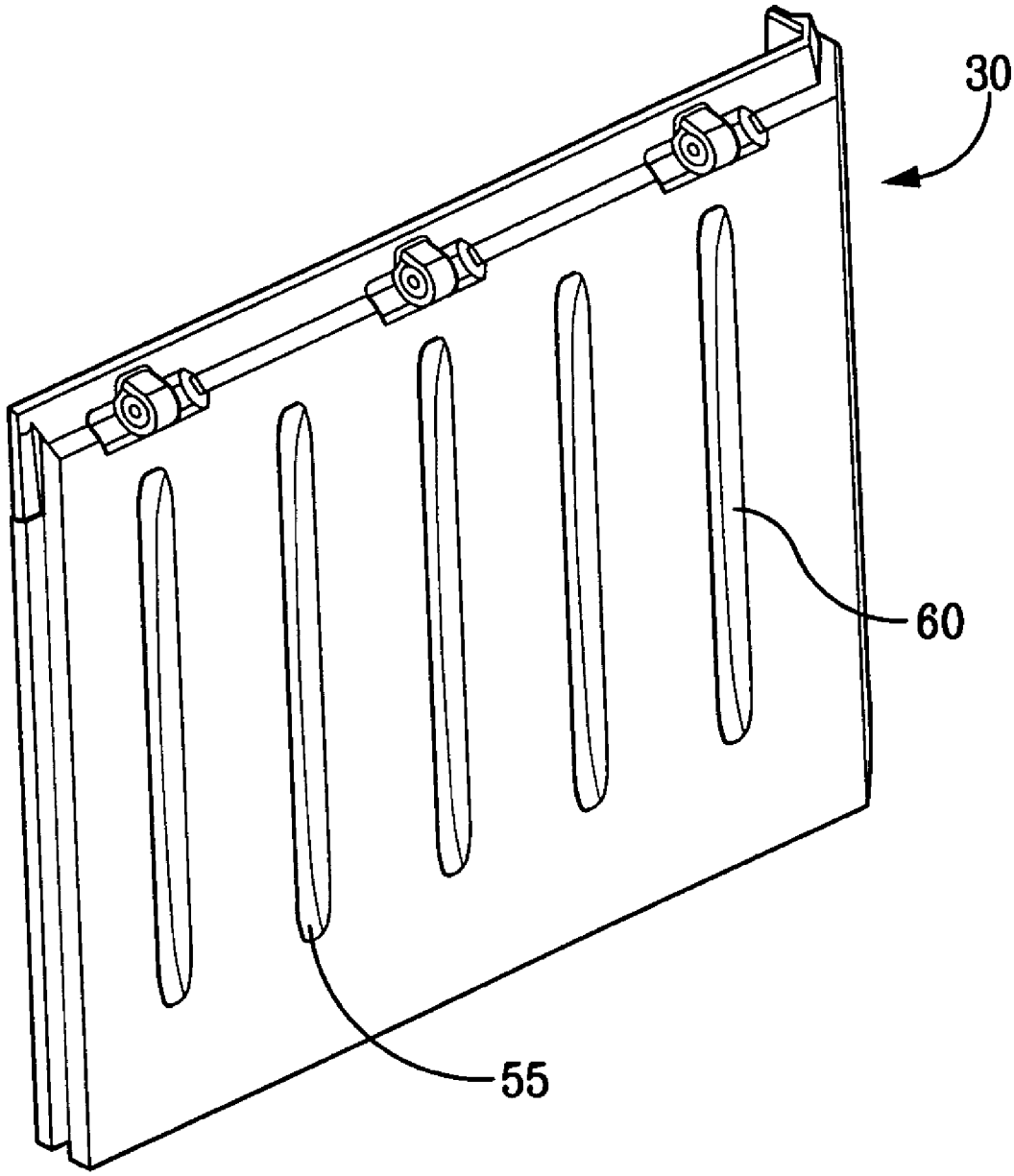
FIG. 3 shows a perspective view of a lower end wall panel in an embodiment of the invention.

With reference to FIGS. 1, 2 and 3, the load bearing capacity of the side walls and the end walls can be increased by incorporating one or more concave indentations 55, each indentation forming an internal arch 60 between inner 45 and outer 50 wall members. As shown in FIGS. 1, 2 and 3, the concave indentations 55 are elongate and are substantially vertical in orientation. The concave indentations can face inward as when in the outer wall member, or they can face outward as when in the inner wall member. A combination of inward and outward facing concave depressions is also contemplated by the current invention.

Without wishing to be bound by theory, the arches defined by the concave indentations 55 provide an internal "roman arch" which resists deformation of the walls by compression forces. As the walls are compressed in a vertical direction, the internal arch resists inward or outward flexing of the walls in a direction approximately perpendicular to the direction of the compression forces.

In an embodiment of the current invention, the side walls 20 are partitioned into at least two removable side wall panels fitting between the roof and the base. In a preferred embodiment, the side wall panels will engage the roof 5 and the base 10.

In an embodiment, the side wall panels have upper and lower edges that engage the roof and base respectively by complimentary tongue and groove means (i.e. upper and lower tongue and groove means respectively). In an embodiment, the tongue and groove means allow at least one side wall panel in each side wall to slidably engage the roof and the base in a substantially lateral direction. The side wall panels may engage or abut one another along adjacent edges.

In an embodiment of the invention, the end walls 15 and the side walls 20 engage each other along mating tongue and groove formations. The tongue and groove means formations have any suitable shape, provided that a groove in an end wall or a side wall is in alignment with a tongue in an adjacent side wall or end wall respectively.

Figure 4A:
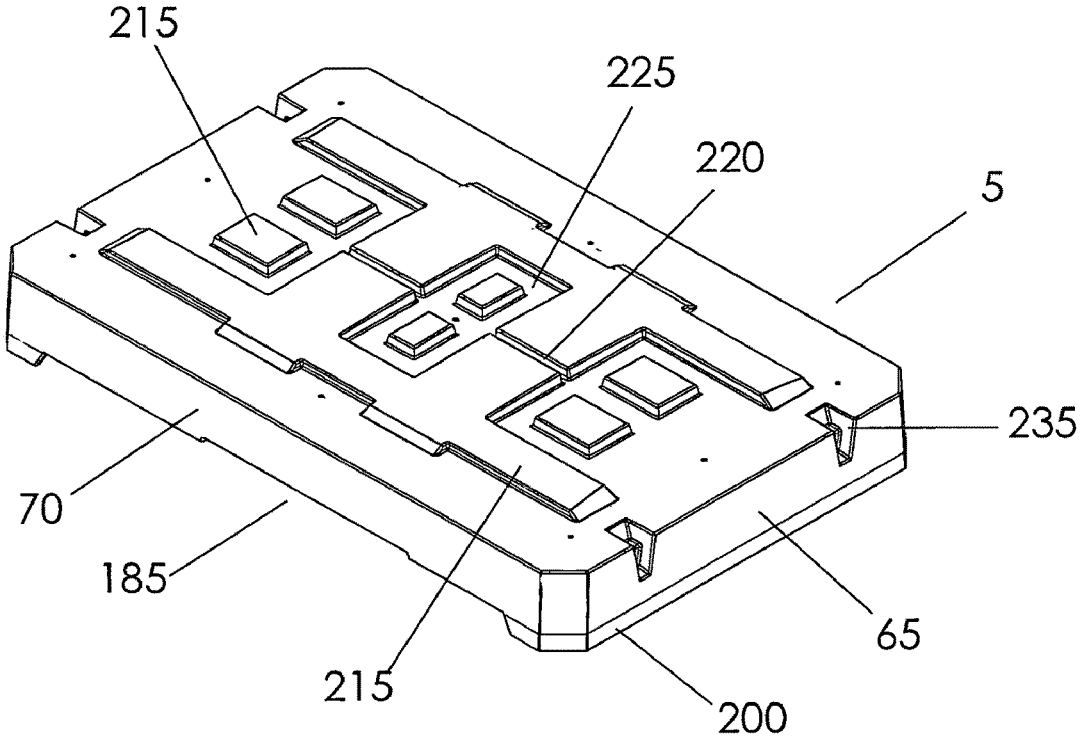
FIGS. 4A and 4B show perspective views of the roof in an embodiment of the invention.
Figure 4B:
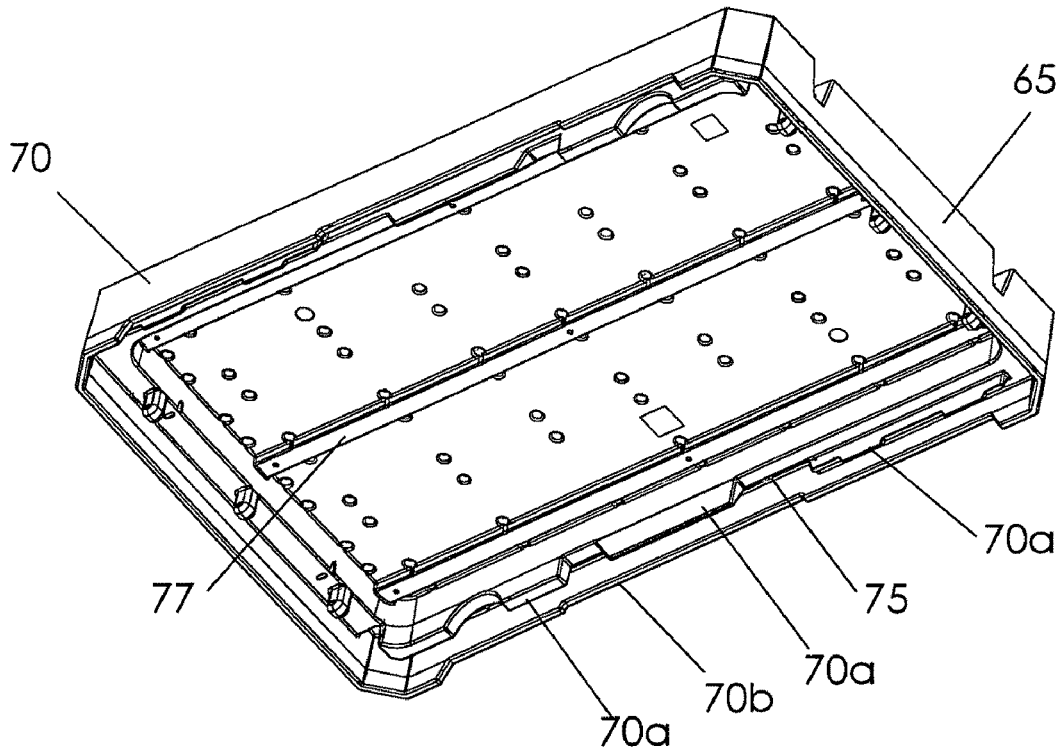

In an embodiment of the invention, and with reference to FIGS. 4A and 4B, the roof 5 has two downwardly extending end skirting walls 65. The upper end wall panels 25 are pivotally attached to the end skirting walls by one or more hinges 41. Similarly, the roof 5 has downwardly extending side skirting walls 70 which engage the side walls 20 on each side of the container.

Figure 4C:
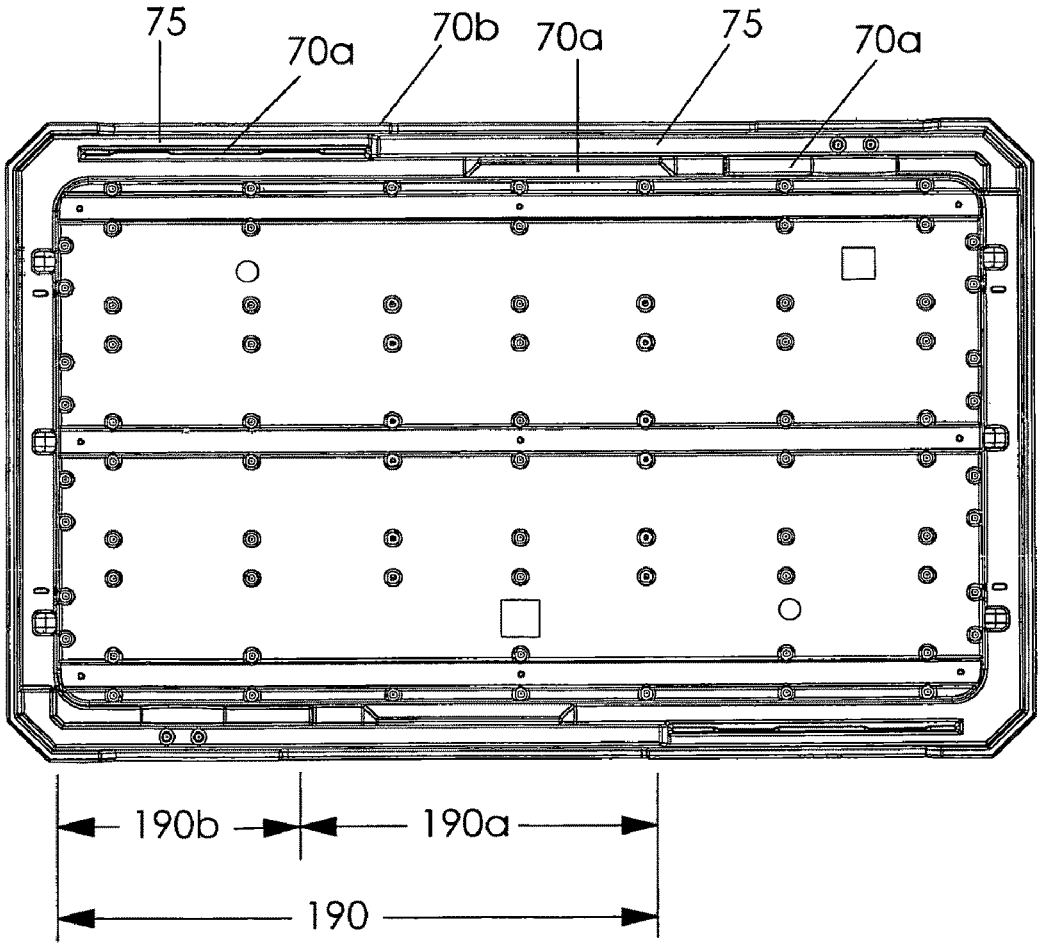
FIG. 4C shows an underside plan view of the roof in an embodiment of the invention.

In an embodiment of the invention and with reference to FIGS. 4B and 4C, each side skirting wall 70 comprises a downwardly extending inner side skirting wall 70*a* which may be continuous or discontinuous and have aligned or offset portions and a continuous outer side skirting wall 70*b*. There is an upper groove 75 disposed between or defined by each inner and outer side skirting wall 70*a* and 70*b*. Preferably, the upper grooves 75 in roof 5 form part of tongue and groove means between the side wall panels and the roof (i.e. the upper tongue and groove means).

In an embodiment of the invention and with reference to FIG. 4B, the roof may have on its underside one or more beams 77. The beams may be made of any suitable material such as, but not limited to, metals or plastics, or they may be integrally molded as part of the roof. Without wishing to be bound by theory, the use of such beams can strengthen the roof against deformation stresses and hence provide structural strength and rigidity.

Figure 5A:
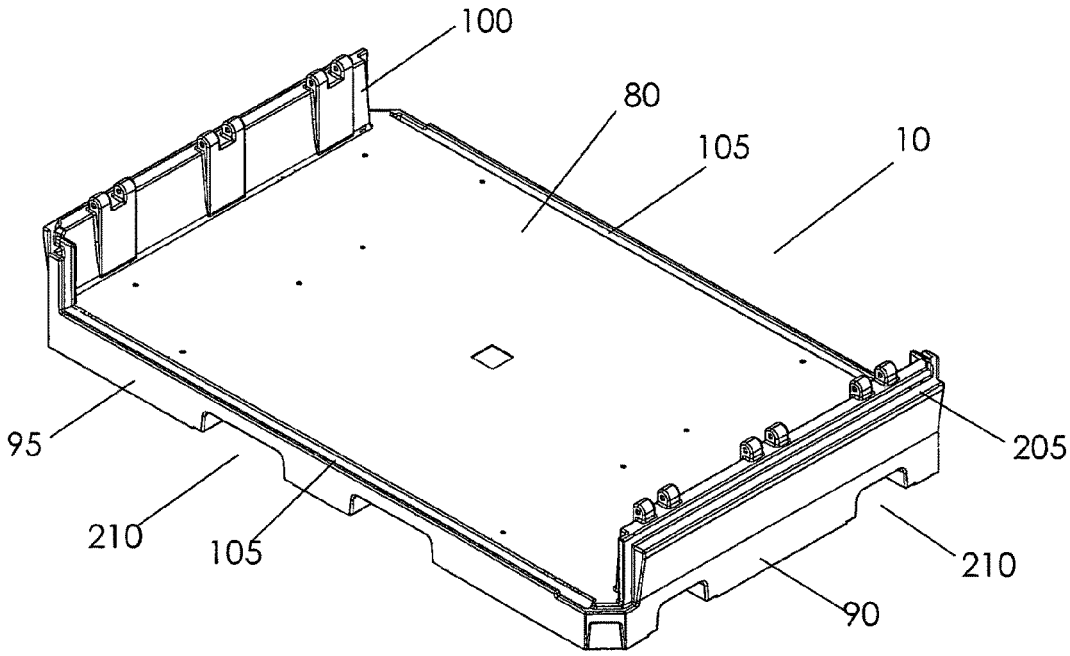
FIGS. 5A and 5B show perspective views of the base in an embodiment of the invention.
Figure 5B:
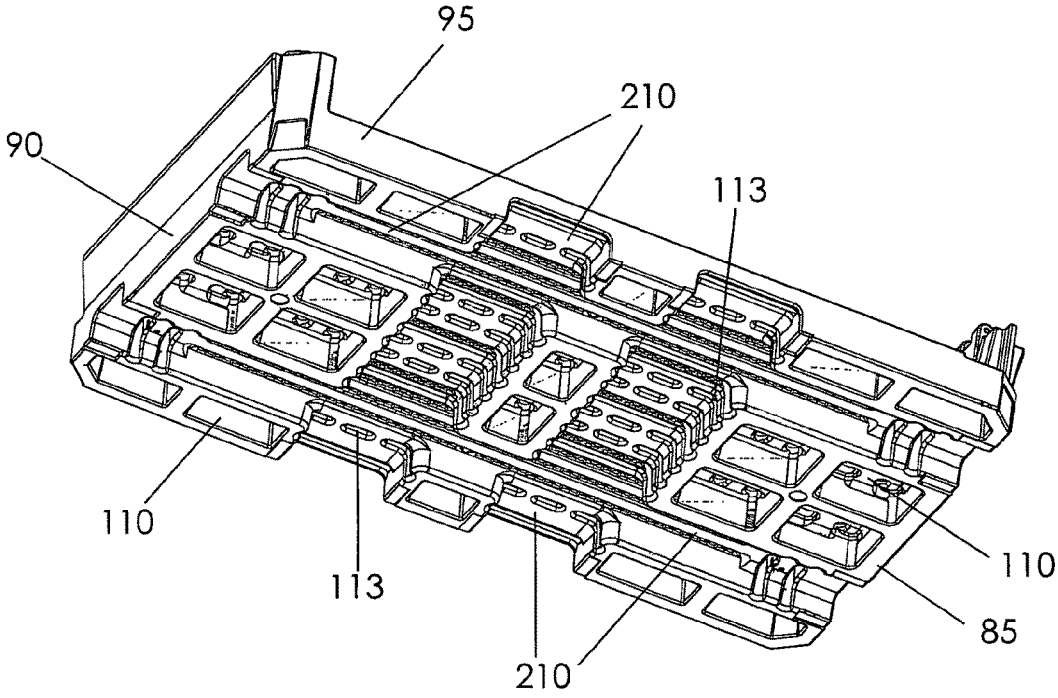

In an embodiment of the invention and with reference to FIGS. 5A and 5B, the base 10 has spaced apart top and bottom surfaces 80 and 85 joined by a pair of base end walls 90 and a pair of base side walls 95. The base also has two upwardly extending end retaining walls 100. The top surface 80 that is between the end retaining walls 100 may serve as a recessed area for storing side wall panels. The lower end wall panels 30 are pivotally attached to the end retaining walls 100 of the base by hinges 42. The base has a pair of lower grooves 105. Each lower groove is disposed in the top surface 80 of base 10 adjacent to each base side wall 95. The lower grooves 105 form part of tongue and groove means between the side wall panels and the base (i.e. lower tongue and groove means).

Figure 6A:
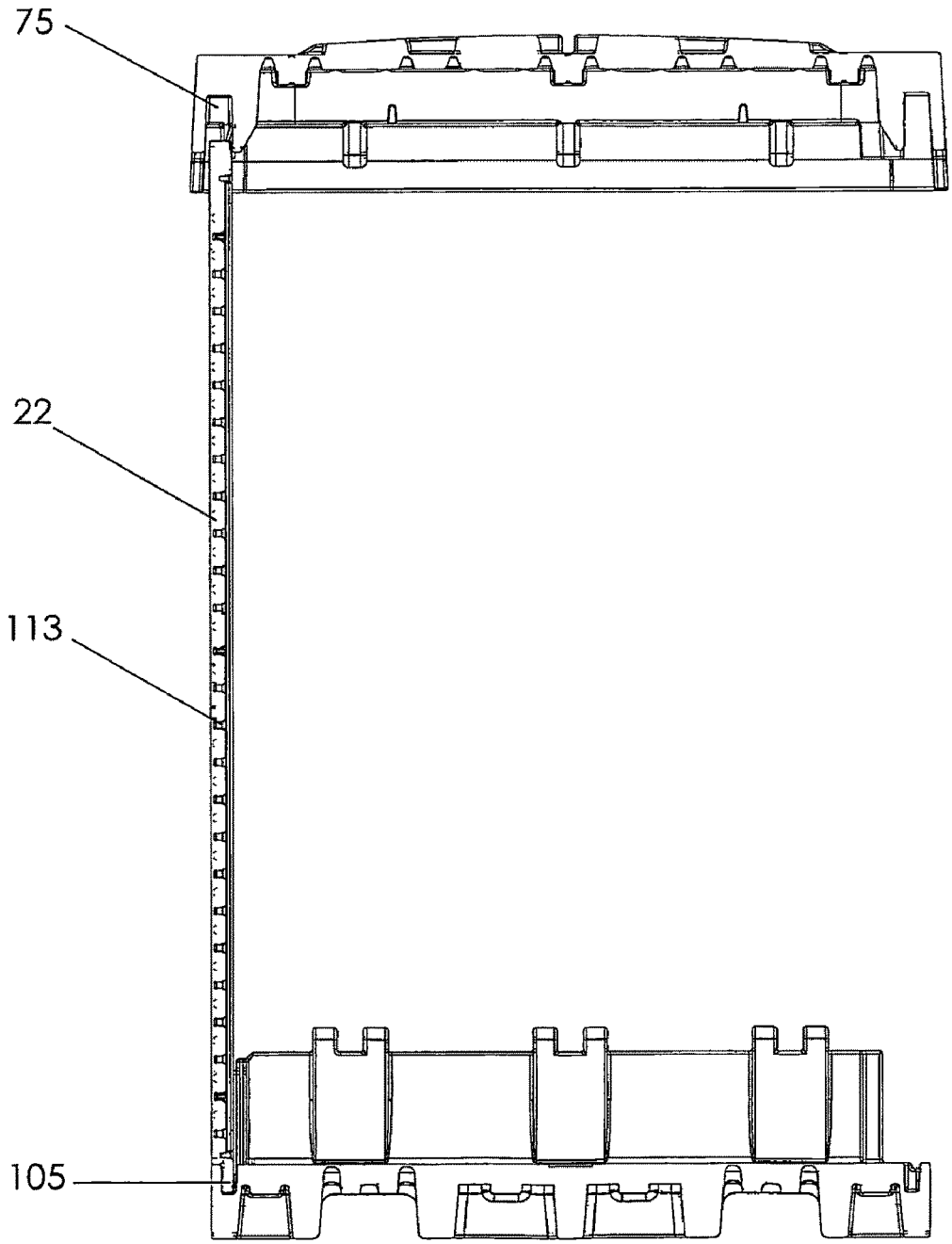
FIG. 6A shows a cross sectional elevation view of the roof, a side wall panel and the base in an embodiment of the invention.

In an embodiment, at least one side wall panel in each side wall has a pair of offset perimeter edges that engage upper grooves 75 and lower grooves 105 of the roof 5 and the base 10 respectively. In another embodiment of the invention and with reference to FIG. 6A, at least one side wall panel in each side wall has both a flat and an offset perimeter edge that engage upper grooves 75 and lower grooves 105 of the roof 5 and the base 10 respectively. In the present invention, each of the side wall panels can have offset and/or flat upper and lower edges which engage grooves 75 and 105.

A reversed tongue and groove means, in which grooves present in the upper and lower edges of the side wall panel mate with a tongued track on the roof and base respectively, is also contemplated by the current invention.

In an embodiment, the base is a rotomolded plastic component having a twinned wall structure defined by an inner wall member and an outer wall member. For clarity, when the base is a twinned wall component, the upper surface 80 of the base will correspond to the inner wall member 45, and the lower surface 85 of the base will corresponds to the outer wall member 50.

With reference to FIG. 5B, the base 10 may have one or more wells 110, which are areas in which the top and bottom surfaces 80 and 85 are closer together than in other portions of the base. In a well, the inner and outer wall members do not actually touch one another (also see FIG. 6A). Without wishing to be bound by theory, the use of such wells may add structural rigidity and strength to the base.

In an embodiment of the invention, the base will have a plurality of "kiss offs" 113. The term "kiss off" refers to a point in a twinned wall component at which the inner and outer wall members 45 and 50 pinch together to make contact with one another. Kiss offs can be inward or outward facing indentations. Use of "kiss offs" in other parts of the collapsible container 1, such as the end walls or the side walls or the roof, is also contemplated by the current invention. It is well known in the art that "kiss offs" increase the structural rigidity and strength of a twinned wall component. The kiss offs may be of any suitable shape, including but not limited to circular, elongate, or oblong. Kiss offs 113 are distinguished from wells 110 in that they represent areas in which the inner and outer wall members make contact with one another.

Figure 6B:
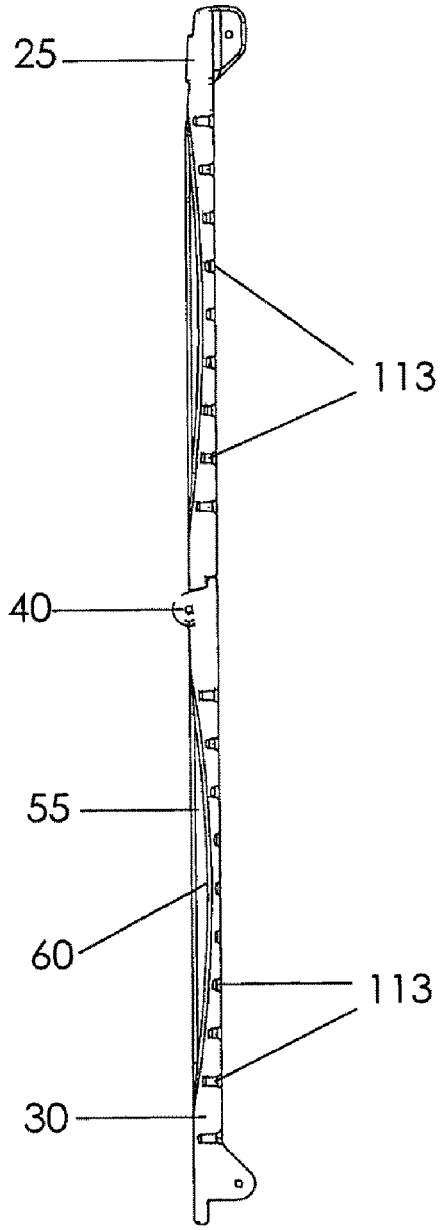
FIG. 6B shows a cross sectional elevation view of an end wall in an embodiment of the invention.

In an embodiment of the invention, one or more kiss offs are incorporated within the concave indentations 55 in one or more of the end walls 15 or the side walls 20 (see FIG. 6B which shows the incorporation of kiss offs 113 within concave indentations 55 of an end wall). By placing kiss off structures within the concave indentations, the inner and outer wall members are held in an approximately parallel fashion under load bearing forces. Without wishing to be bound by theory, holding the inner and outer wall members approximately parallel to one another enhances the load bearing capacity of the walls by enhancing the function of the concave indentations as perpendicular roman arches which resist inward and outward flexing motions.

Figure 6C:
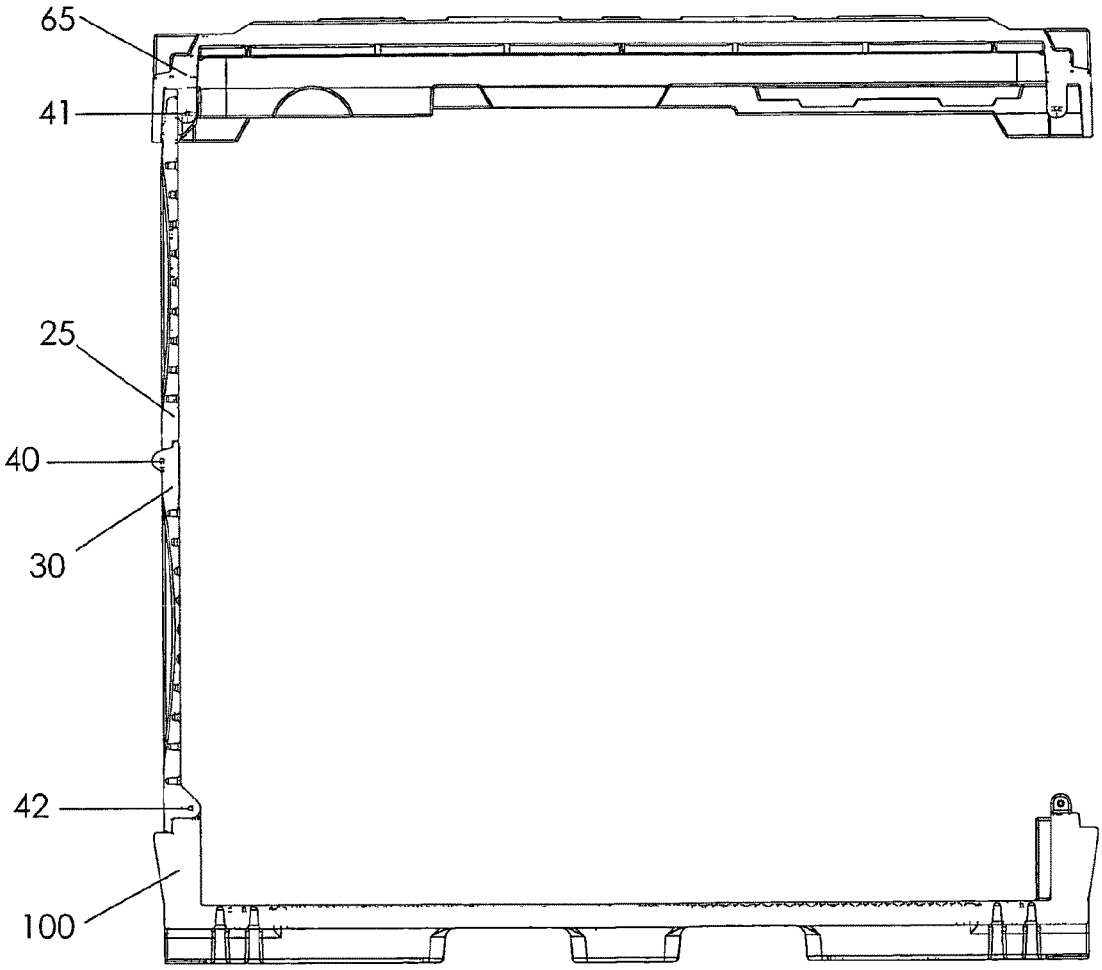
FIG. 6C shows a cross sectional elevation view of the roof, an end wall and base in an embodiment of the invention.

With reference to FIG. 6C, the upper end wall panels 25 are pivotally attached to the end skirting walls 65 by one or more than one offset hinge 41. The lower end wall panels 30 are pivotally attached to the retaining walls 100 of the base by one or more than one offset hinge 42. The upper end wall panels are horizontally pivotally attached to the lower end wall panels by one or more than one offset hinge 40.

The upper end wall panels 25 and the lower end wall panels 30 have abutting or mating adjacent edges. In a preferred embodiment, an outwardly offset pair of lower edges on the upper end wall panels 25 mate with an inwardly offset pair of upper edges on the lower end wall panels 30 when the container is erect, as shown further in FIGS. 6B, 7A and 7B. This configuration of mating offset edges prevents water from entering the container along the horizontal axis 35 and provides a stop against the outward folding of the end walls beyond a substantially vertical position. Alternatively, the combination of abutting edges and an outwardly offset hinge, although less weather resistant, still prevents the outward folding of the end walls beyond a substantially vertical position.

The lower end wall panels 30 and the end retaining walls 100 have abutting or mating adjacent edges. In a preferred embodiment, an outwardly offset pair of lower edges on lower end wall panels 30 mate with an inwardly offset pair of upper edges on the end retaining walls 100 when the container is erect, as shown further in FIG. 6C.

In the present invention, at least one end wall will have a slide lock along adjacent lateral edges of upper and lower side wall panels. The slide lock may be present on either or both lateral edges of one or both of the end walls, but is preferentially present along one lateral edge of each end wall.

Figure 8A:
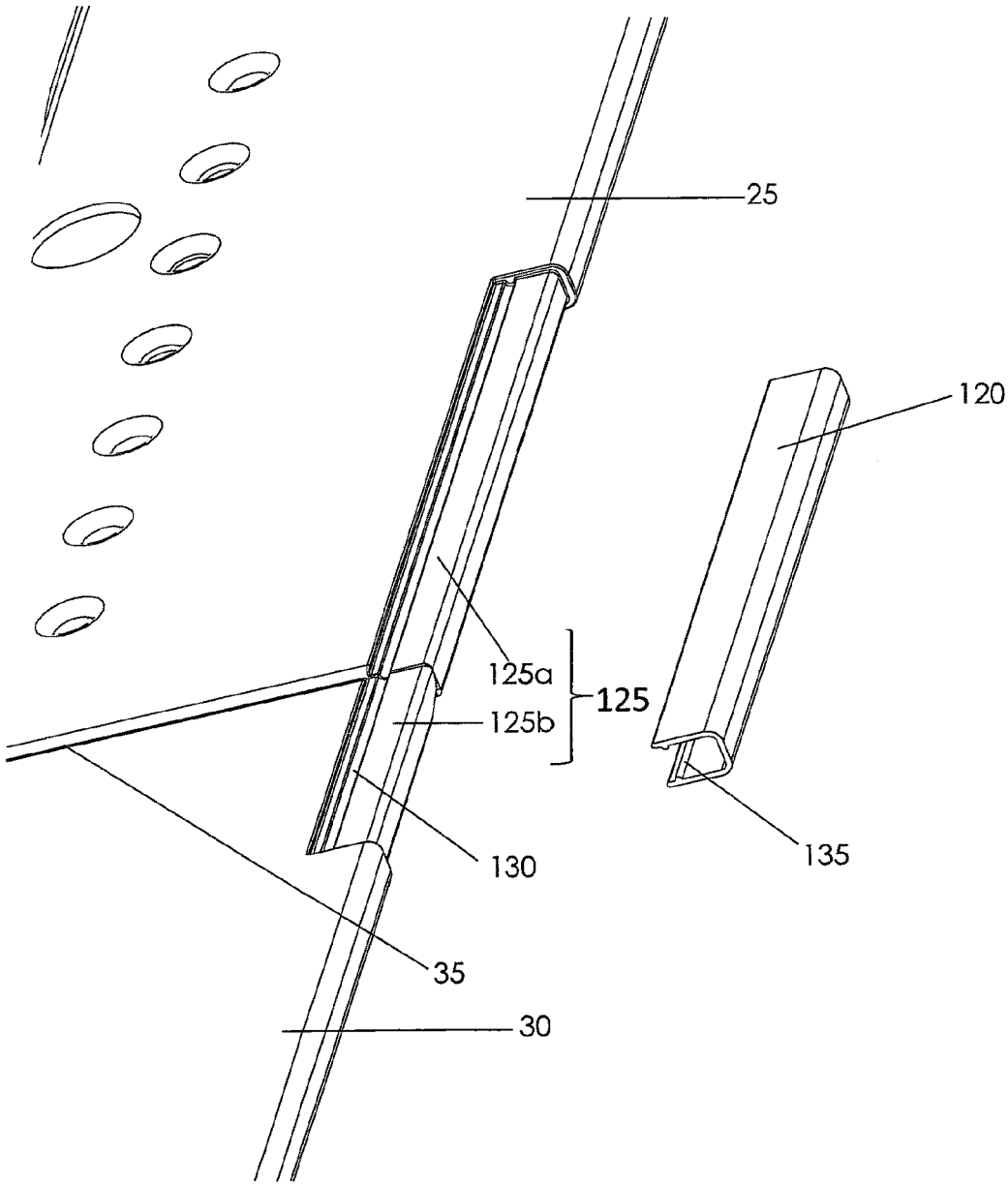
FIG. 8A shows an exploded perspective view of the slide lock in an embodiment of the current invention.
Figure 8B:
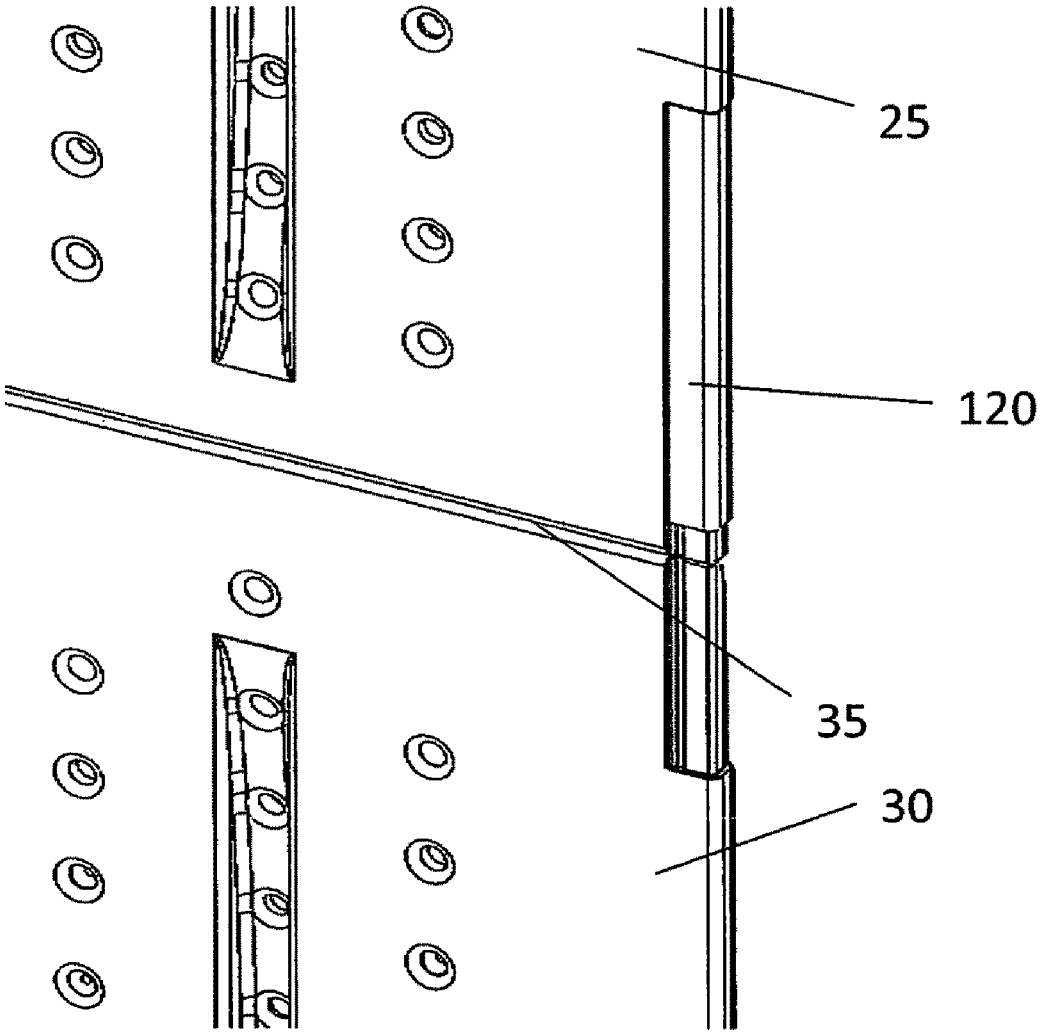
FIG. 8B shows a perspective view of the slide lock in an open position for an embodiment of the invention.
Figure 8C:
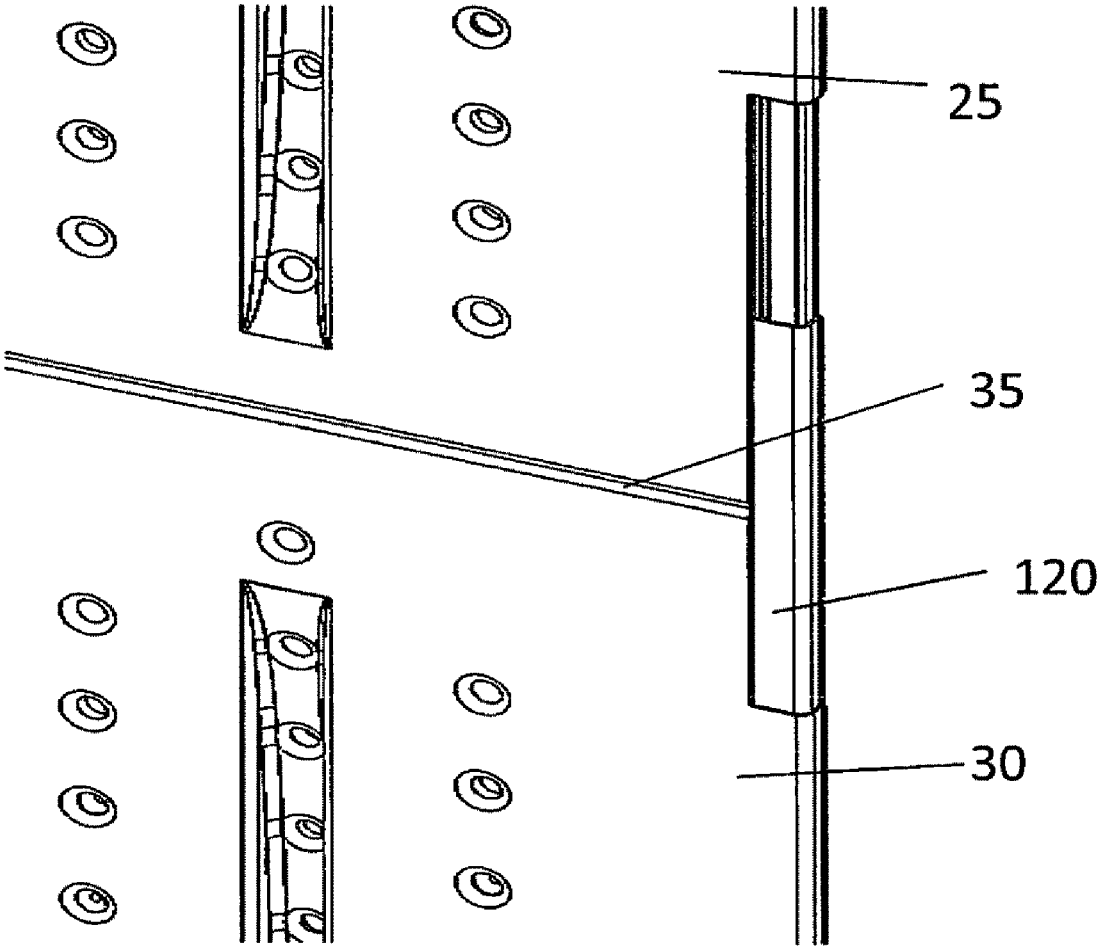
FIG. 8C shows a perspective view of the slide lock in a closed position for an embodiment of the invention.

In an embodiment of the invention and with reference to FIGS. 8A-8D, the slide lock comprises a partially tubular component 120 which engages the upper and lower end wall panels of an end wall and which slides between an open position and a closed position. With reference to FIGS. 8A-8C, the partially tubular component 120 rides on a track 125 molded within and along a common lateral edge of the upper and lower end wall panels near the horizontal axis 35 about which the upper and lower end wall panels are pivotally attached to one another. With reference to FIG. 8A, the track 125 is made up of a portion 125*a* along an edge of the upper end wall and a portion 125*b* along an edge of the lower end wall panel. Each portion of the track is proximal to the horizontal axis 35.

When in the open position, the slide lock resides on a portion of the track entirely within the upper end wall panel or entirely within the lower end wall panel. When in a locked position, the slide lock will traverse the horizontal axis 35 about which the upper and lower end wall panels are pivotally attached to one another, thereby preventing pivoting motion about the axis 35.

In an embodiment, when in the open position the partially tubular component 120 resides on a portion of the track entirely within the upper end wall panel (portion 125*a* as shown in FIG. 8B). With reference to FIG. 8C, when in a locked position, the partially tubular member 120 will traverse the horizontal axis 35 about which the upper and lower end wall panels are pivotally attached to one another, thereby preventing pivoting motion about the axis 35. Preferably, the track is dimensioned so as to provide a stop against which the tubular component 120 abuts when in either the locked or unlocked positions, and which prevents the tubular member from sliding to locations highly distant from the horizontal axis 35.

Figure 8D:
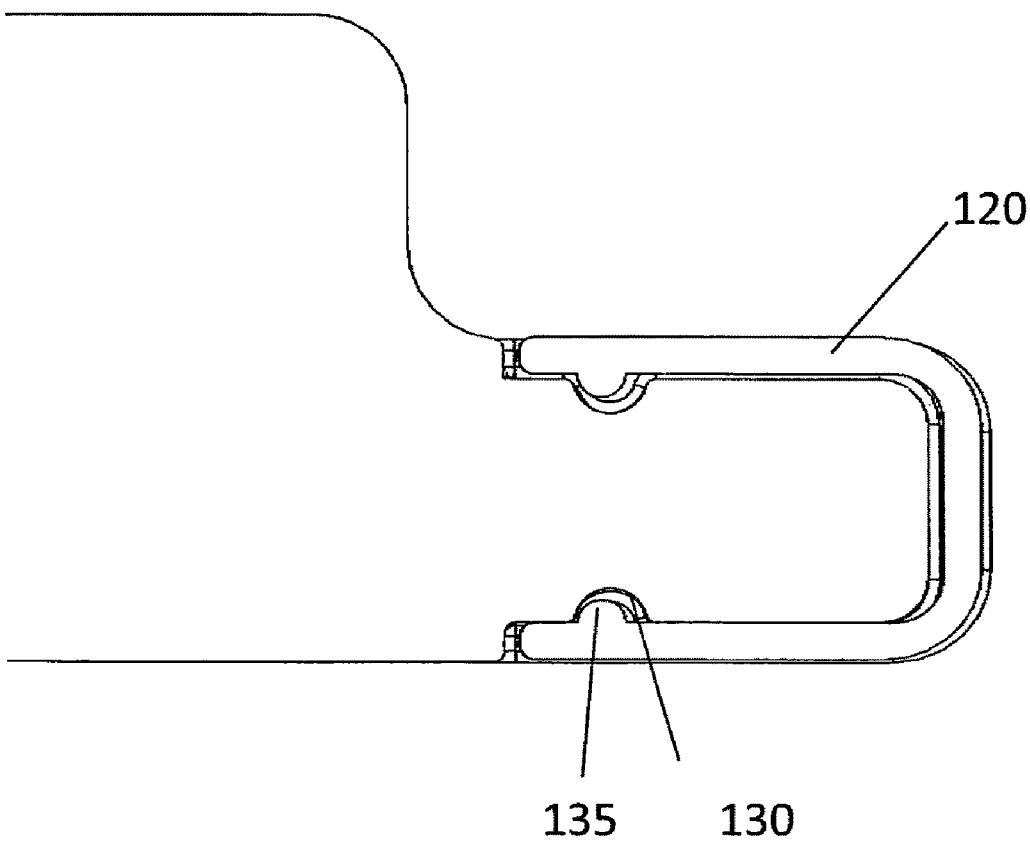
FIG. 8D shows a cross sectional view of the slide lock in an embodiment of the invention.

The partially tubular member 120 has an elongate opening or open side which accommodates and engages the track 125. In a specific embodiment, the slide lock tubular member has a "U" shaped cross section which engages the track as shown in FIG. 8D. The shape of the tubular member 120 and the track 125 are not of particular importance, so long the tubular component can slide along said track. The tubular component can be made from a wide variety of materials including various plastics, composites, and metals so long as the material has sufficient strength to avoid cracking or breaking when in a locked position and when inward or outward pressure is applied to the end walls or when compression forces are applied to an erect container. Preferably the tubular component is made of metal.

In an embodiment of the invention, and with reference to FIGS. 8A and 8D, the track will comprise a pair of track grooves 130 which receives a pair of elongate protrusions 135 present on the inner surface of the tubular member 120. The track grooves 130 and protrusions 135 may be of any shape, so long as they hold the tubular member 120 on the track 125.

In another embodiment the track will comprise a plurality of detents which receive a plurality of protrusions on the inner surface of the tubular member so as to accommodate movement between a locked and unlocked position.

Other variations of the slide lock may be used with the current invention, so long as the slide lock comprises a slidable component engaging a lateral edge of an end wall so as not to fall off and which, when in a locked position, traverses the axis 35 so as to prevent the inward folding of the end walls and when in an unlocked position does not traverse the axis 35 so as to permit inward folding of the end walls.

In the present invention, the tubular component 120 and the track portions 125*a* and 125*b* are preferably dimensioned so as not to interfere with mutually engaging, mating or abutting edges of a side wall 15 and an end wall 20.

In a specific embodiment, the tubular component 120 and the track portions 125*a* and 125*b* must be of sufficiently small and/or narrow dimensions to allow the entire slide lock to nest within mutually engaging edges of adjacent end and side walls.

In an embodiment, the entire slide lock will fit within and/or form part of a vertical tongue and groove means between adjacent end and side walls. For example, the slide lock may be part of one edge of a pair of offset edges when present on an end wall (see FIGS. 8D and 9). Alternatively, the slide lock may be part of a flat or non-offset edge of an end wall.

Figure 9:
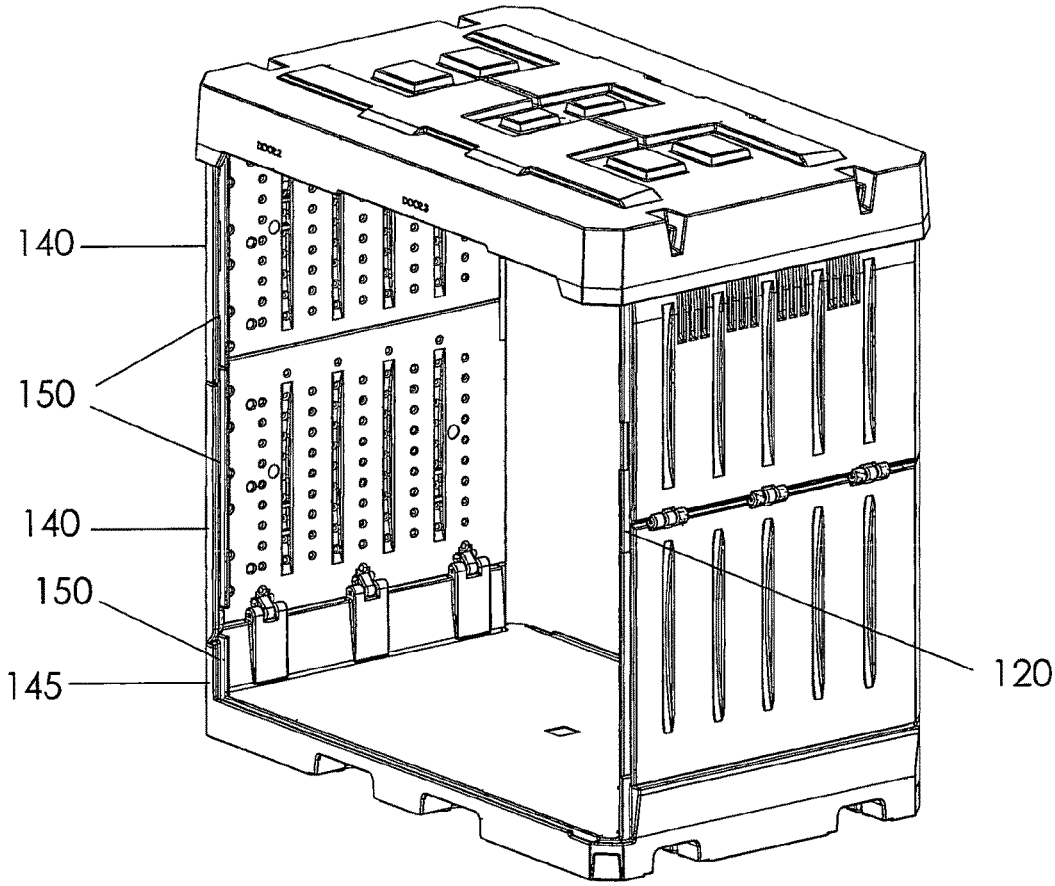
FIG. 9 shows a perspective view of an embodiment of the invention.
Figure 10:
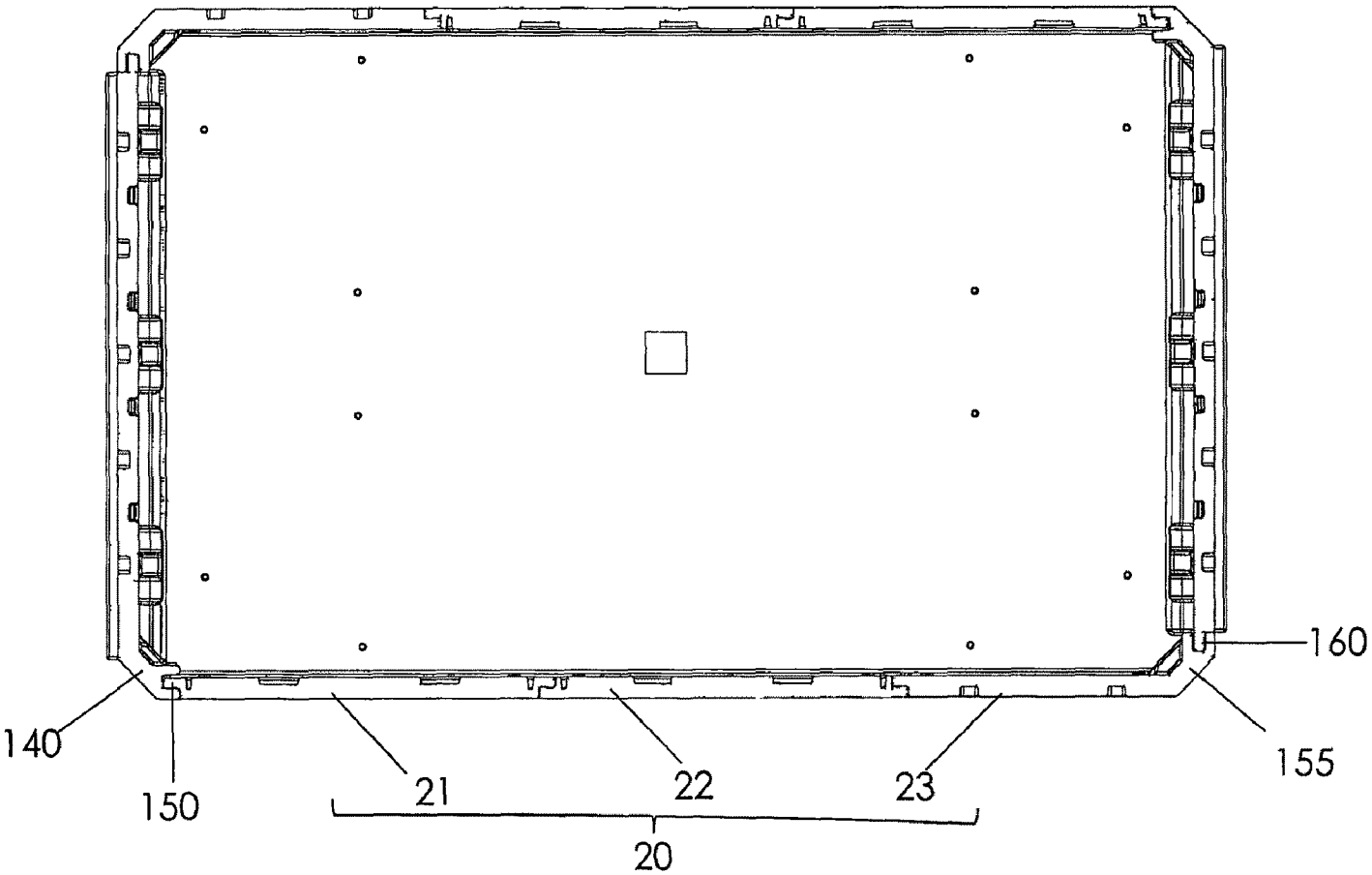
FIG. 10 shows a cross sectional plan view of the end walls and side walls of an embodiment of the invention.

In an embodiment of the invention and with reference to FIGS. 9 and 10, the end walls 15 and the retaining walls 100 have on one lateral side, perpendicular corner extensions 140 and 145 respectively which mate with an edge of an adjacent side wall 20 to define a pair of vertical corner sections. The corner extensions 140 and 145 have a first vertical groove 150 disposed therein which mates with an edge of an adjacent side wall 20 (i.e. a vertical tongue and groove means). Non-mating, abutting adjacent edges can also be used as can a reversed tongue and groove interaction, in which the groove, 150 is present in an adjacent edge of the side wall, while the tongue is present in an adjacent edge of the end wall and retaining wall.

To facilitate inward folding of the end walls along axis 35, the corner extensions 140 on upper and lower end wall panels 25 and 30 may have beveled upper and lower ends respectively. Alternatively, to facilitate inward folding of the ends walls along axis 35, the corner extensions 140 on upper and lower end wall panels 25 and 30 may have recessed upper and lower ends respectively (i.e. the corner extension does not extend all the way to the edge of the longer perpendicular edge of an end wall, see circled area in FIG. 11). A combination of recessed and beveled upper and lower ends respectively is also contemplated as shown in FIG. 11.

Figure 12:
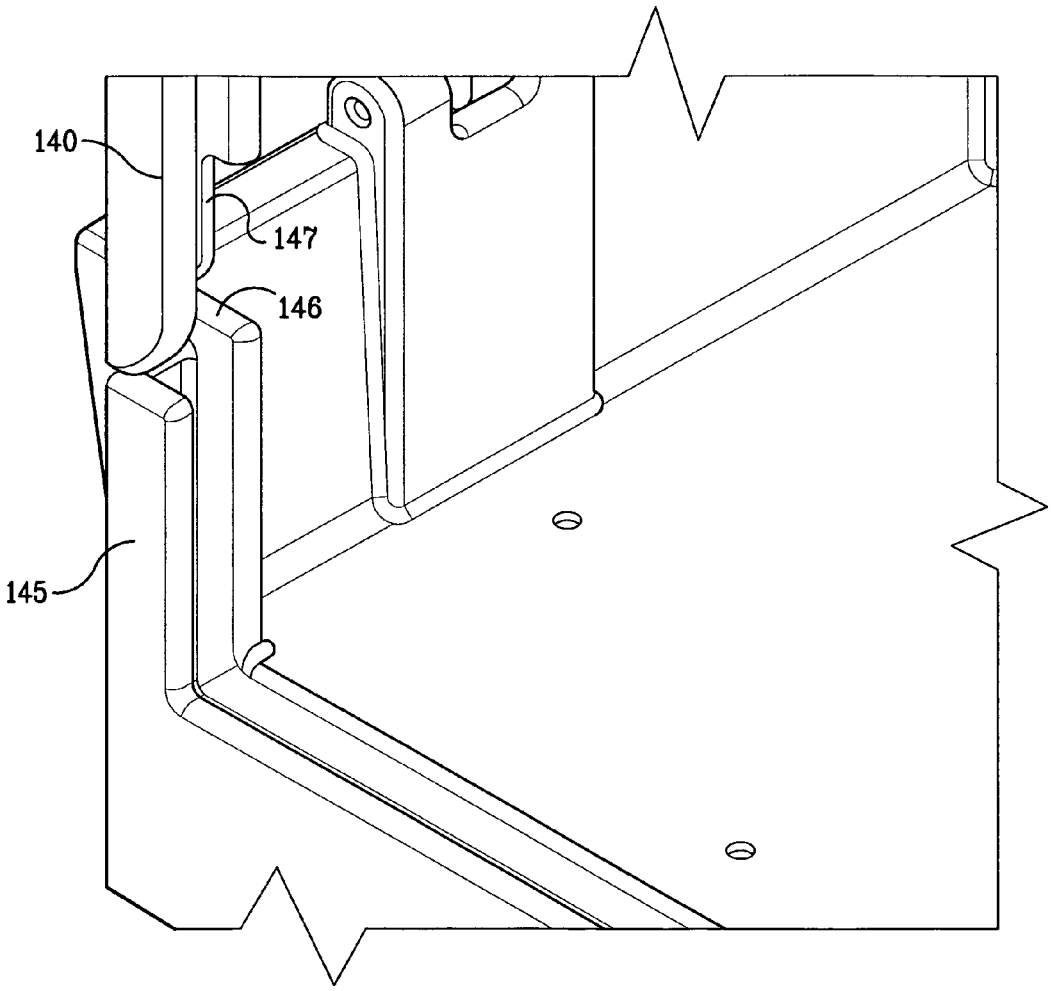
FIG. 12 shows a partial perspective view of an embodiment of the invention.

The corner extension 145 on the end retaining walls may have a squared or leveled upper end. In one embodiment of the invention, the corner extensions 140 and 145 on the lower end wall panels and the end retaining walls respectively have adjacent beveled and squared end surfaces which evenly abut one another. This arrangement leaves a small space between corner extensions 140 and 145. Preferably, the corner extensions 140 and 145 on the lower end wall panel and the end retaining wall respectively have adjacent beveled and squared end surfaces which abut one another unevenly as shown in FIG. 12. The upper end of corner extension 145, inward of grove 150, has an upwardly extending portion 146 which overlaps with the space between corner extensions 140 and 145, outward of groove 150, providing additional weatherproofing for erected container 1. The corner extension 140 on lower end wall panels 30 has a cutout 147 inward of groove 150, which mates with the upwardly extending portion 146 on corner extension 145 when the container is collapsed.

Figure 13:
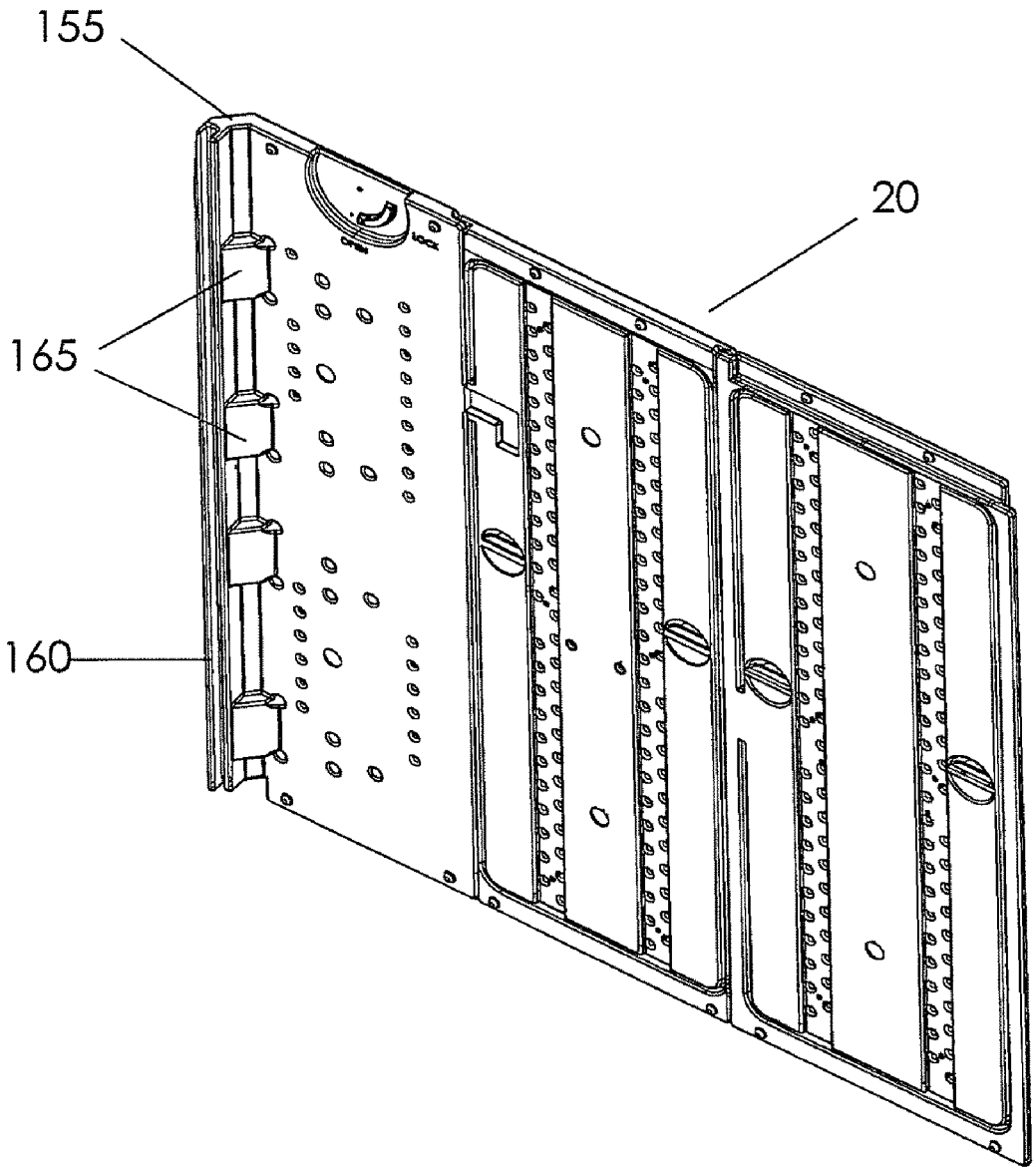
FIG. 13 shows a rear perspective view of a side wall in an embodiment of the invention.

In an embodiment of the invention and with reference to FIGS. 10 and 13, the side walls 20 have on one lateral side a perpendicular corner extension 155 which mates with an edge of an adjacent end wall 15 and end retaining wall 100 to define a second pair of vertical corner sections. The corner extensions 155 have a second vertical groove 160 disposed therein which mates with an edge of an adjacent end wall 15 and end retaining wall 100 (i.e. a vertical tongue and groove means). Non-mating, abutting adjacent edges can also be used as can a reversed tongue and groove interaction, in which the groove 160 is present in an adjacent edge of the end wall (and end retaining wall 100) while the tongue is present in an adjacent edge of the side wall.

Figure 11:
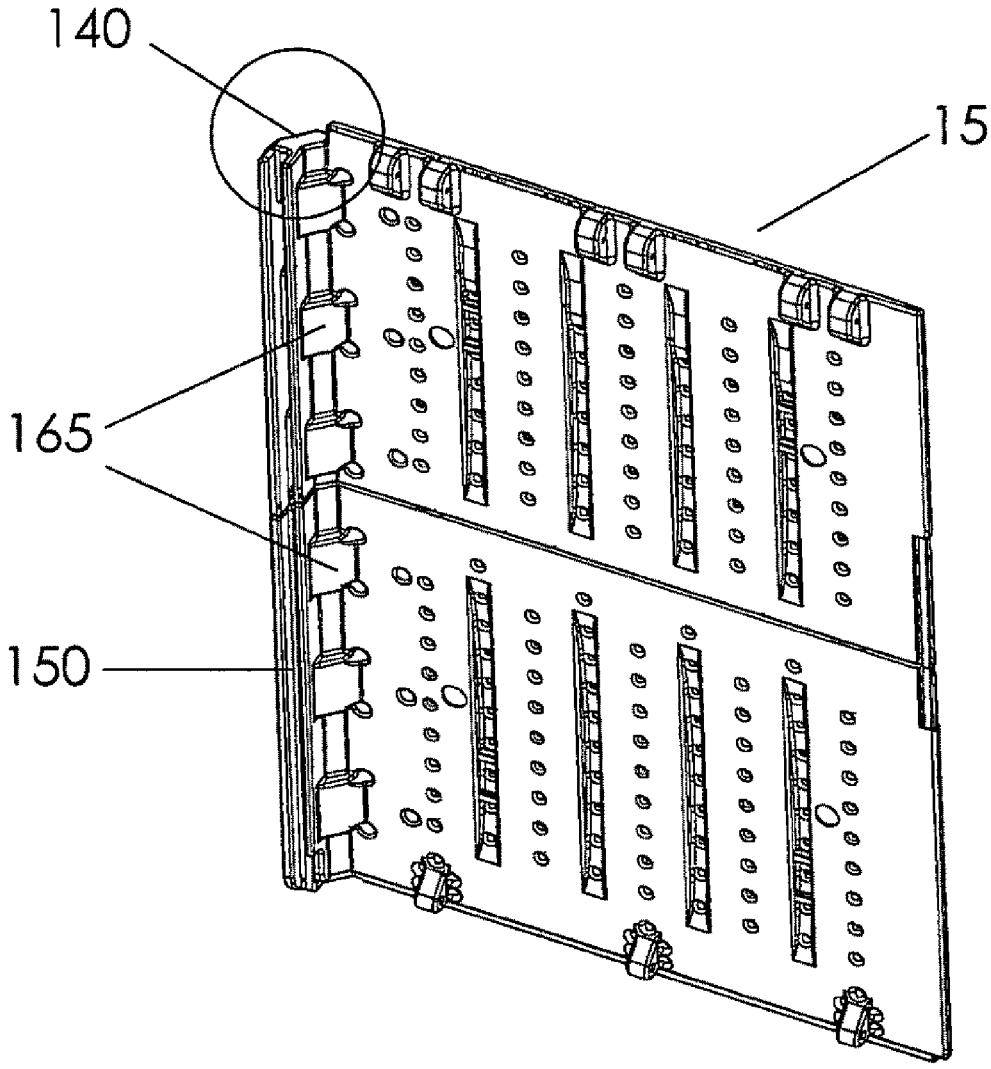
FIG. 11 shows a rear perspective view of an end wall in an embodiment of the invention.

The corner extensions 140 of the end walls and the corner extension 155 of the side walls may optionally be reinforced by integrally molding a rib 165 within an inner corner as shown in FIGS. 11 and 13. The rib spans the perpendicular sections of corner extensions 140 and 155, to strengthen the same against inward and/or outward bending or flexing. Any number of ribs can be present and can take any number of shapes.

Figure 14:
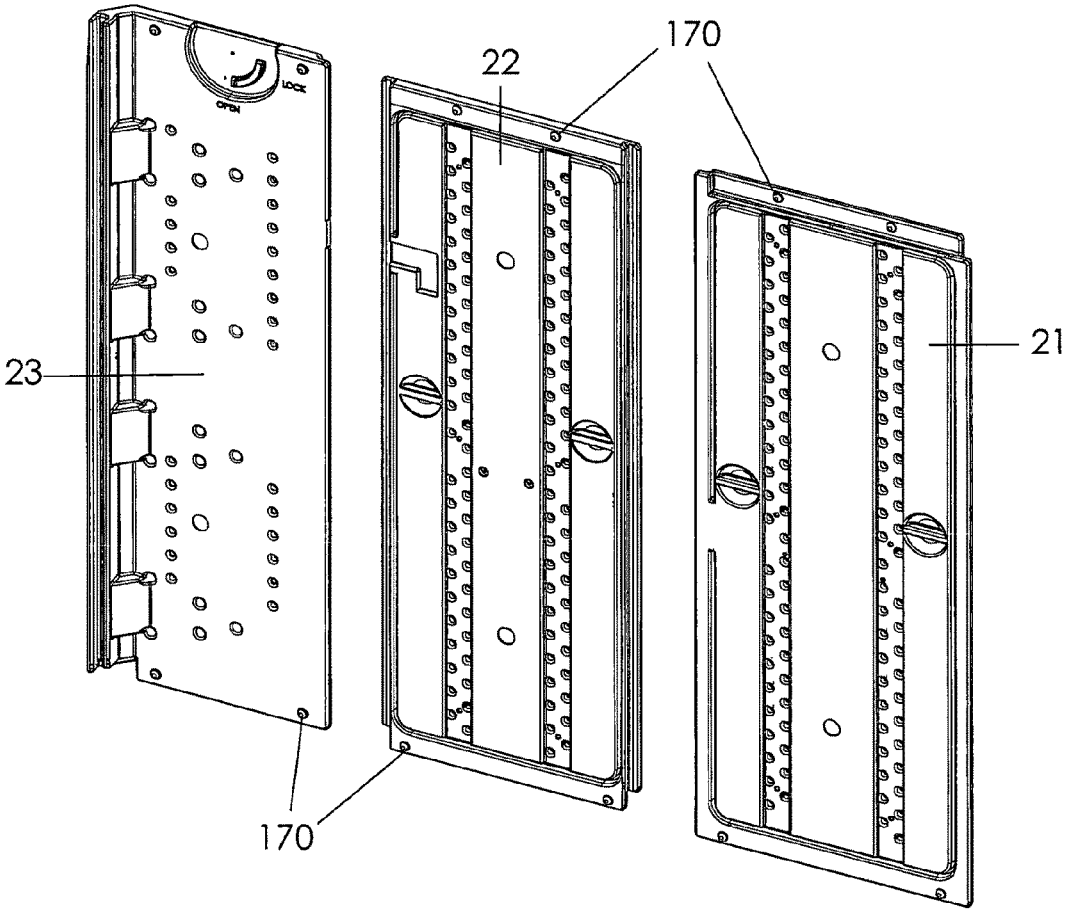
FIG. 14 shows a rear perspective view of a set of side wall panels in an embodiment of the current invention.

In an embodiment of the invention and as shown in FIGS. 1, 13 and 14, each of the side walls 20 are partitioned into first 21, second 22 and third 23 sequentially adjacent side wall panels.

In a specific embodiment, the first and second side wall panels 21 and 22 are generally flat, while the third side wall panel 23 has an L-shaped cross section the short side of which defines corner extension 155.

In an embodiment, the first 21 and second 22 side wall panels may have a pair of offset perimeter edges that slidingly engage the upper groove 75 and the lower groove 105. In another embodiment, the first and/or second side wall panels have flat upper and/or lower edges which ride directly within the upper groove 75 and the lower groove 105. A combination of flat and offset upper and lower edges as well as flat or offset lateral edges may also be used for the side wall panels 21 and 22. Hence, the first and second side walls can have the same or different perimeter edge profile. In either case, the edge of the first wall panel 21, whether offset or flat, also engages the first lateral groove 150 in corner extensions 140 and 145 of an adjacent end wall and retaining wall respectively.

In another embodiment of the invention, the first and second side wall panels have offset lateral edges which mate with one another. Alternatively, the first and second side wall panels have flat edges which abut one another.

The L-shaped side wall panels 23 may optionally be reinforced by integrally molding a rib 165 within an inner corner as shown in FIG. 13. The rib spans the perpendicular sections of the L-shaped side wall panels to strengthen the same against inward and/or outward bending or flexing. The rib can be present in any number and can take any number of shapes.

The perpendicular corner extension 155 of each third side wall panel 23 have disposed therein a second lateral groove 160 which mates with the edge of an adjacent end wall. The side wall panel 23 also has a pair of offset perimeter edges that mate with an adjacent edge of the second door panel 22, with the lower groove 105 of the base 10 and with the upper groove 75 of the roof 5. The upper and lower edges of the third side wall panel may also be flat and directly engage the upper and lower grooves 75 and 105 and/or have flat lateral edges which abut against adjacent side wall panel 22 and end wall 15.

In an embodiment of the invention and with reference to FIG. 14 the side panels 21, 22, and 23 will have one or more knobs 170, which are preferentially integrally molded and which are located adjacent to or near a perimeter edge which is received in lower groove 105 and/or upper groove 75. The purpose of the knobs 170 is to wedge a side wall panel more tightly within lower groove 105 and/or upper groove 75. Hence, knobs 170 reduce the tolerance or space that may be left between the thickness of a side wall panel and the width of lower and upper groves 105 and 75 respectively, in order to decrease the wobbling or movement of side panels when seated within said upper and lower grooves.

Figure 15A:
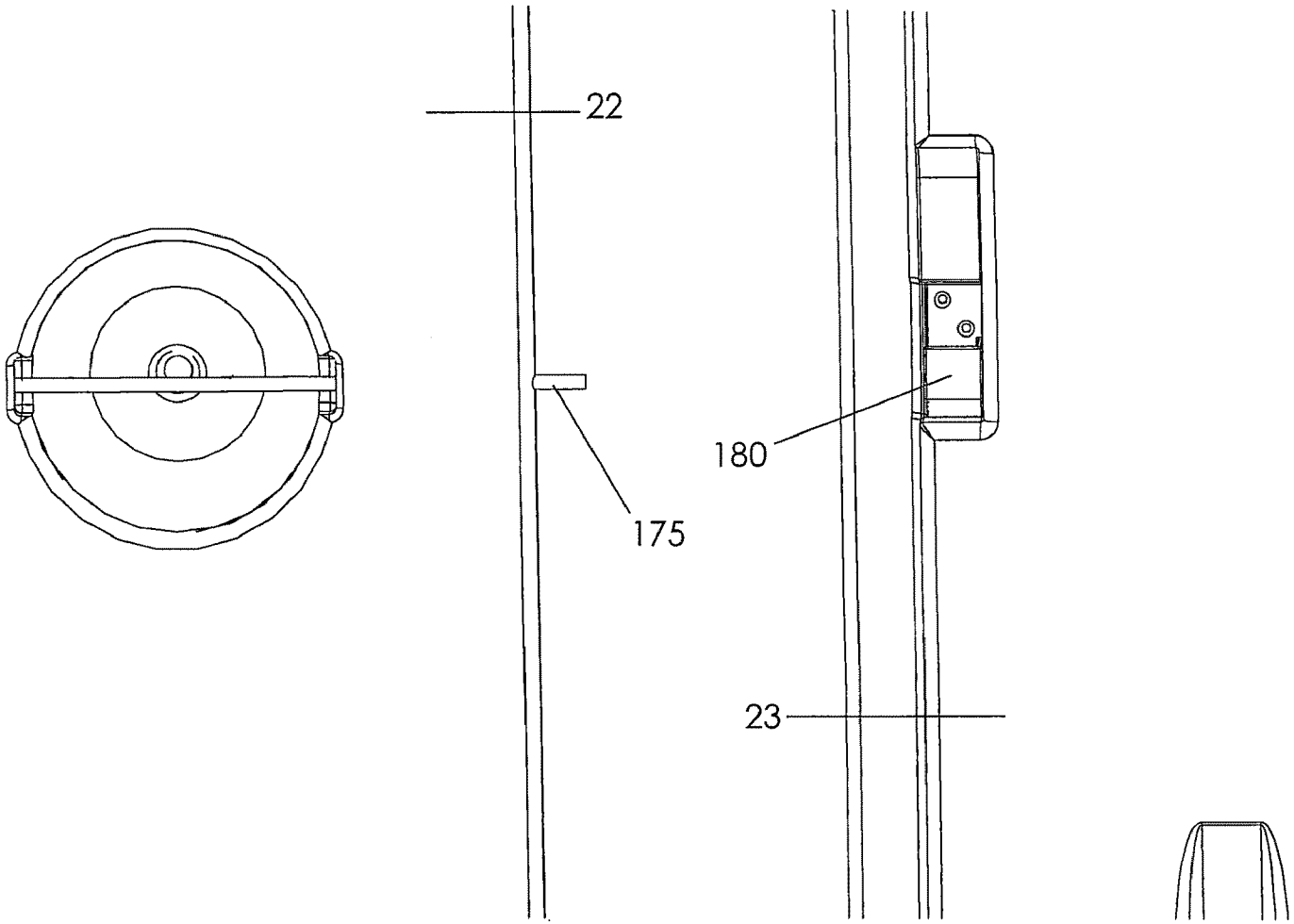
FIGS. 15A and 15B show expanded perspective views of a guide pin and a receiver slot of an embodiment of the invention.
Figure 15B:
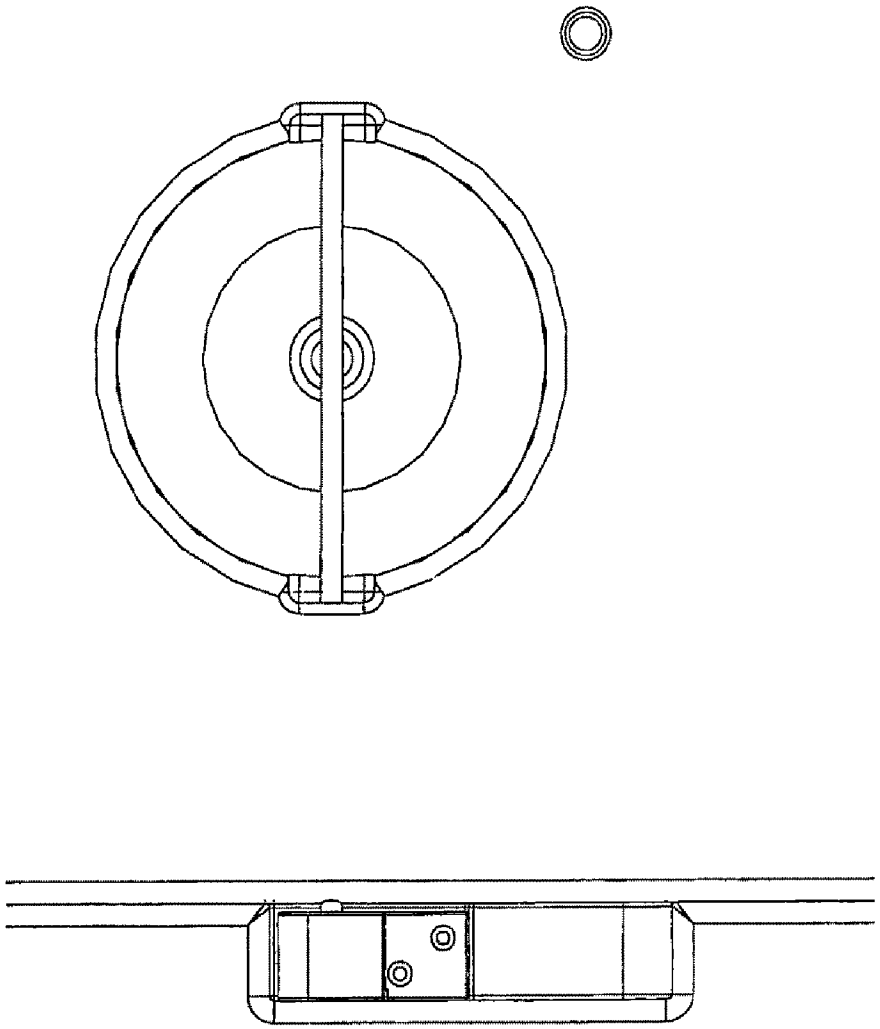

Optionally, adjacent side wall panels 21, 22, and 23 will contain complimentary guide pins 175 and receiver slots 180. The guide pins 175 extend laterally from an edge of a side wall panel and are received by a receiver slot 180 positioned near an edge of an adjacent side wall panel. As shown in FIGS. 15A and 15B, the receiver slot is preferably countersunk within the outer surface of a side panel so as to properly align with the guide pin extending from a lateral edge of an adjacent side wall panel. The guide pin and the receiver slot will be at the same vertical height on adjacent side wall panels. The guide pin helps to align a side wall panel with respect to lower tongue and groove means and to align adjacent side wall panels along mutually engaging, mating or abutting edges when adding side wall panels to the container.

Figure 15C:
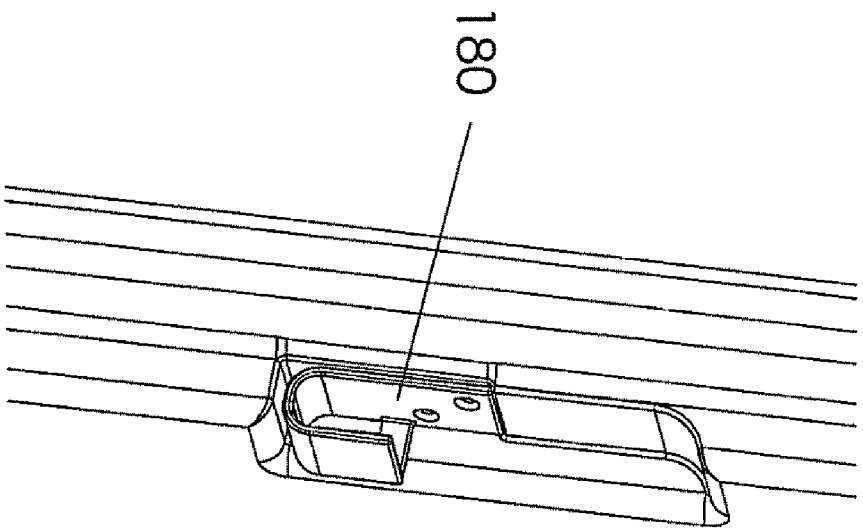
FIG. 15C shows a perspective view of the receiver slot in an embodiment of the invention.

FIG. 15B shows the guide pin 175 engaging a receiver slot 180 for adjacent side wall panels for a specific embodiment of the current invention. As shown in FIG. 15C, the receiver slots have a U-shaped cross section, but any shape which suitably receives a guide pin can be used. The guide pins and receiver slots can be made of any suitable material, but are preferably metal components which are added to the side wall panels after rotomolding (i.e. they are not integrally rotomolded into the side wall panels). Optionally, recesses may be integrally molded into the side wall panels to receive the guide pin and receiver slot. Guide pins and receiver slots may be fixed to the side wall panel surfaces using any conventional attachment means, such as, but not limited to, threaded fasteners, screws and bolts.

Figure 16:
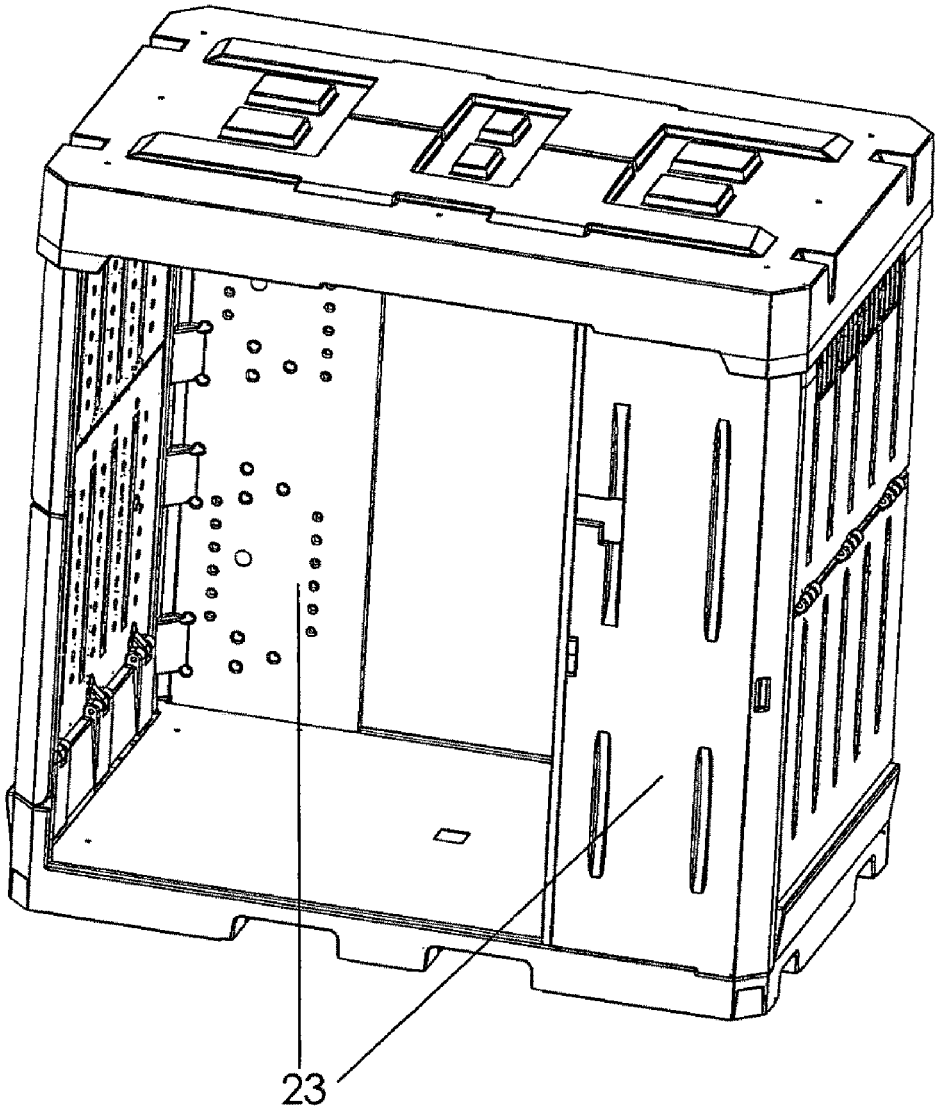
FIG. 16 shows a perspective view of an embodiment of the invention

As shown in FIG. 16, for an embodiment of the invention, the side wall panels 23 provide structural support for an erected container, when the side wall panels 21 and 22 have been removed to provide access to the container.

In a preferred embodiment of the current invention, the tongue and groove means between the side wall panels and the roof will have at least one section 190 dimensioned to loosely engage at least one side wall panel aligned with the section, so that a side wall panel can be removed from the container when aligned with the section.

In an embodiment, and with reference to FIGS. 4B and 4C, the section 190*a* in each upper groove 75, is dimensioned to allow upward displacement of side wall panels 21 and 22 when aligned with the section. Upward displacement of a side wall panel allows for disengagement of the tongue and groove means holding the side wall panel in place between the roof 5 and the base 10. As a result, side wall panels 21 and 22 (side wall panels 21 and optionally side wall panels 22 are laterally slidable in grooves 75 and 105) can be removed from the container by alignment with the section 190*a* followed by disengagement of the tongue and groove means by upward displacement. The location of section 190*a* is indicated by a cutout portion 185 in the side skirting walls 70 (see FIG. 4A). The side wall panels 23 have an L-shaped cross section and are not laterally slidable for alignment with the section 190*a*. To permit removal of side wall panels 23, a section 190*b* aligned with each side wall panel 23 is present in each upper groove 75. The section 190*b* permits upward displacement of the side wall panels 23 thereby disengaging the tongue and groove means so that side wall panels 23 can be removed from container 1.

The container has at least one locking means that prevents upward displacement of a side wall panel that is in alignment with a section dimensioned to loosely engage a side wall panel (i.e. sections 190*a* and 190*b*) so that the side wall panel cannot be removed from the container.

In an embodiment, the locking means comprises one or more than one dead bolt, which locks adjacent side wall panels to one another.

In another embodiment, the locking means is a cam disk 195 in communication with a side wall panel and a section dimensioned to loosely engage a side wall panel. The cam disk is rotatable between a locked position and an unlocked position. When in a locked position, the cam disk 195 reduces the vertical dimension of the section dimensioned to loosely engage a side wall panel, to block upward displacement of a side wall panel. When in an unlocked position, the cam disk 195 does not alter the dimensions of the section dimensioned to loosely engage a side wall panel, thereby allowing upward displacement of a side wall panel.

In one embodiment of the invention, the cam disk can be rotatably attached to a side wall panel adjacent to or within the upper tongue and groove means.

The cam disk may be flat or have a wedged portion.

Figure 17A:
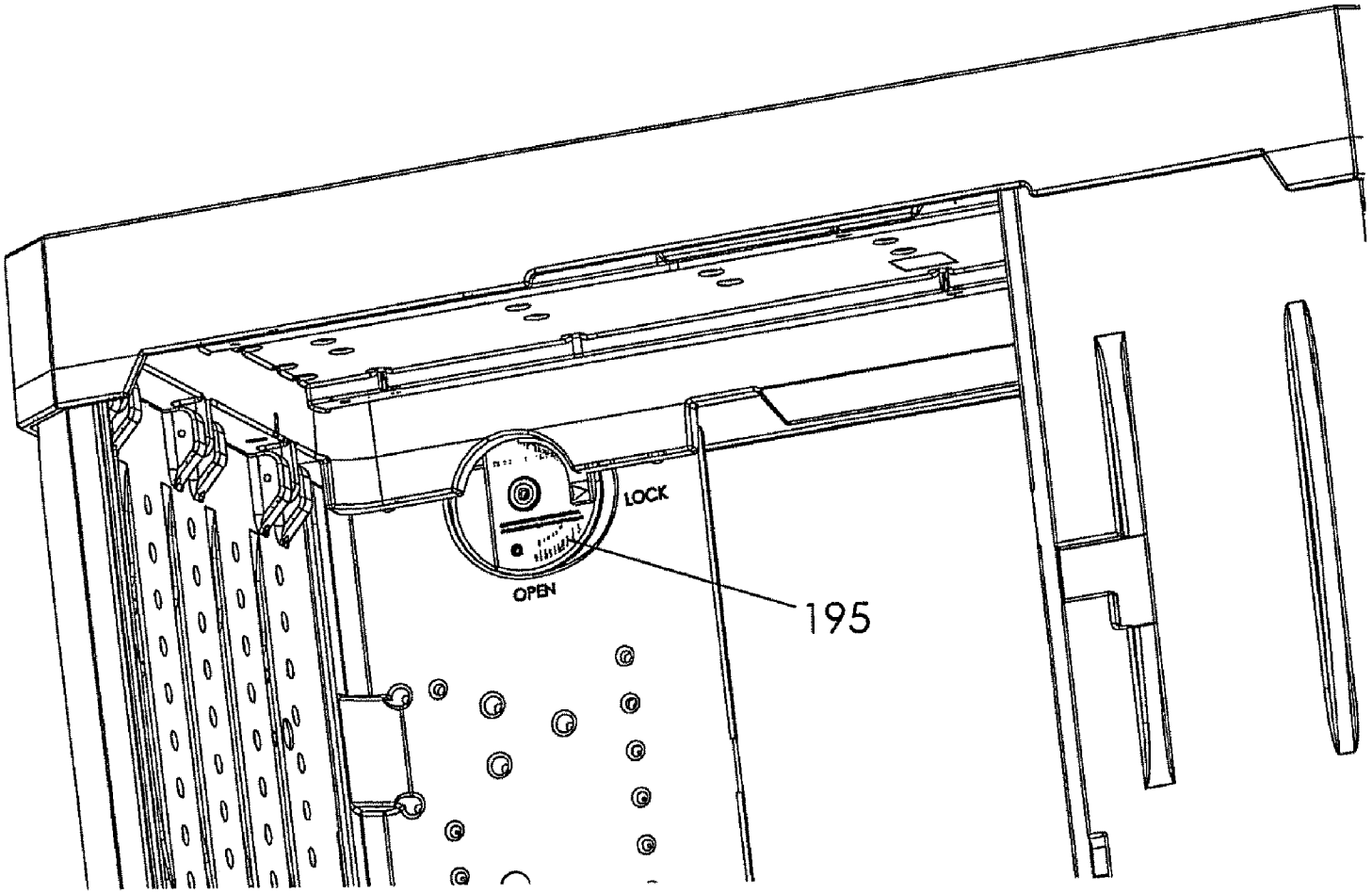
FIGS. 17A and 17B show perspective views of a cam lock in an embodiment of the current invention.
Figure 17B:
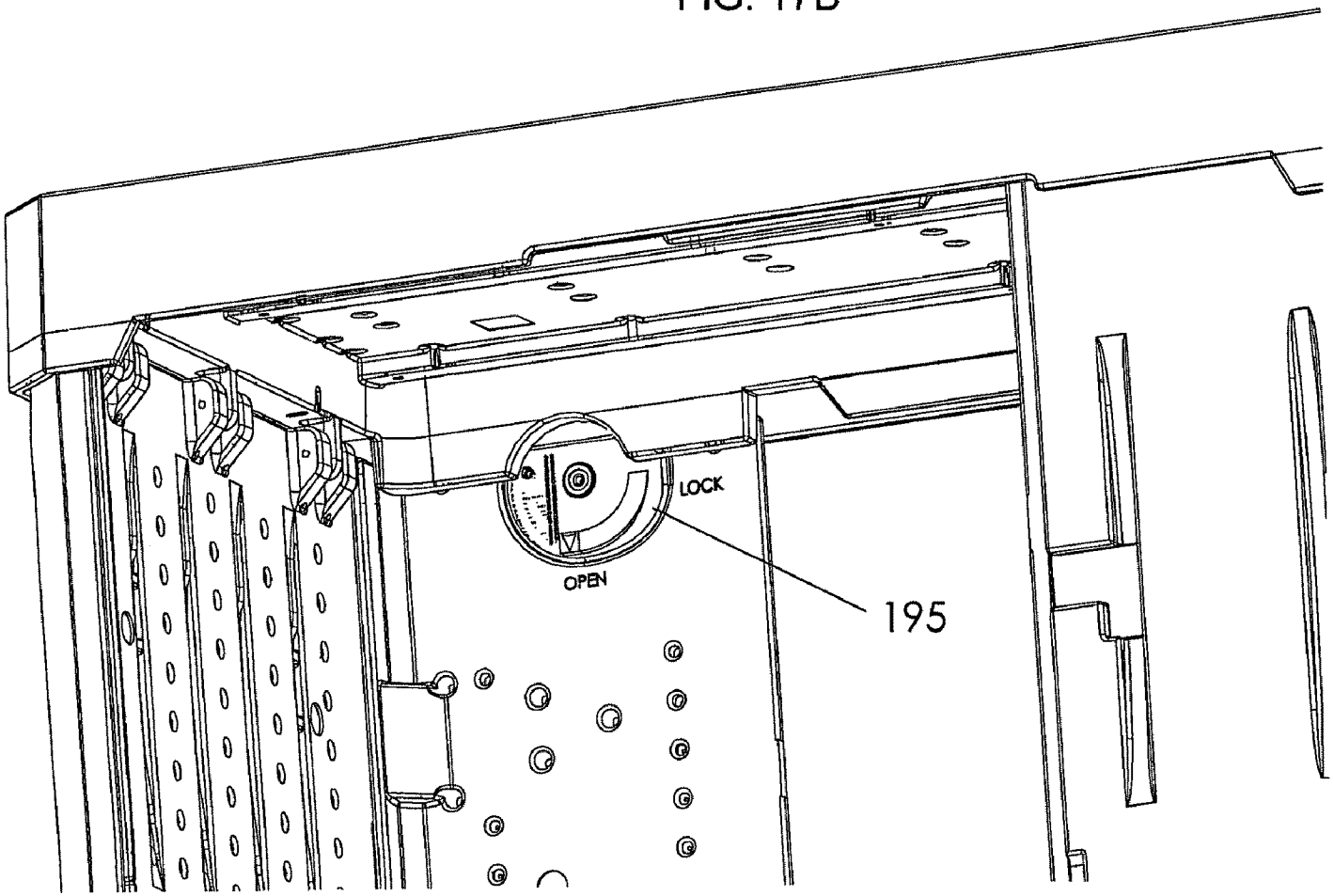
Figure 17C:
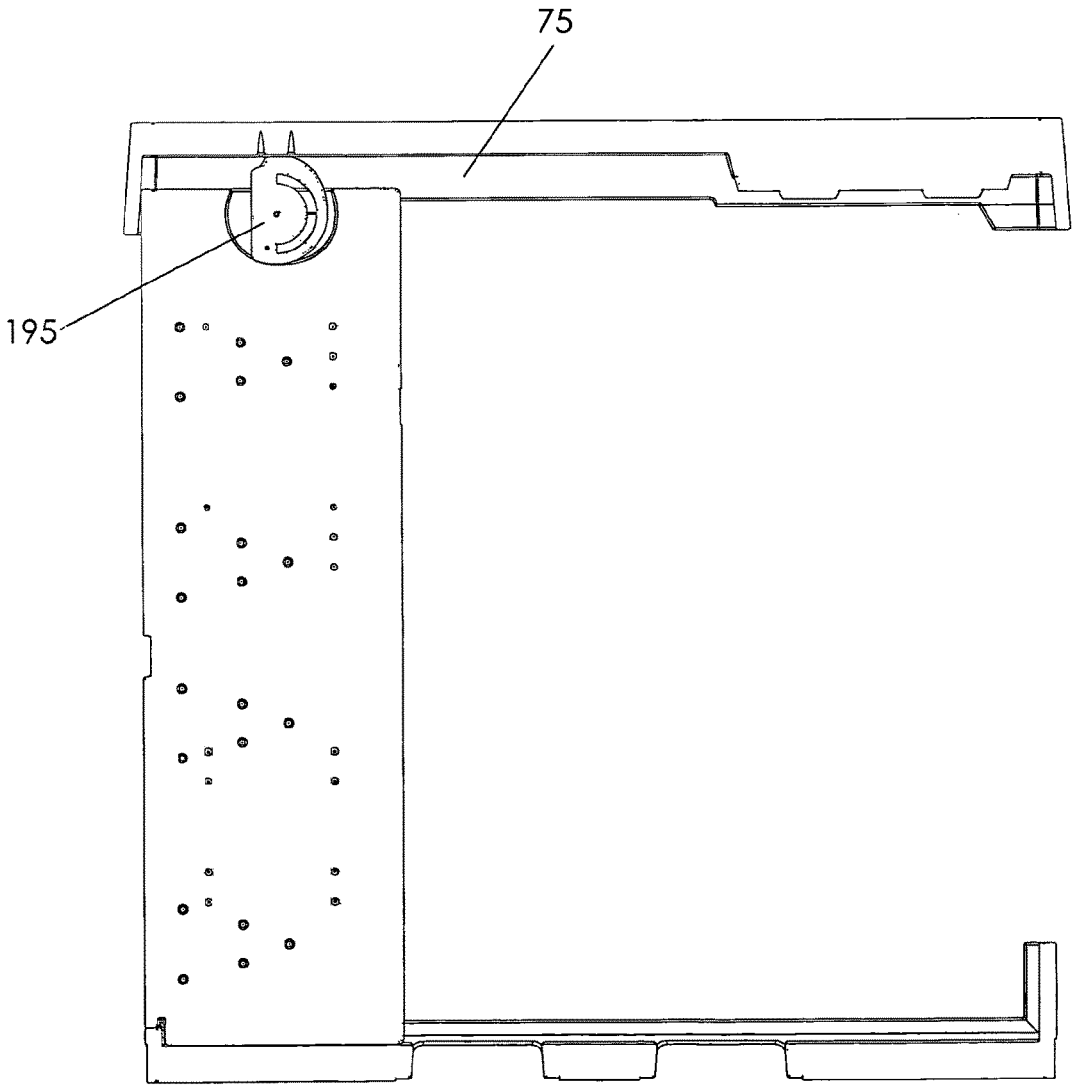
FIG. 17C shows a sectional plan view of a cam lock rotated to a locked position.

In an embodiment of the invention, a cam disk 195 is attached to the container proximal to an upper edge of side wall panels 23. For example, a cam disk 195 can be directly attached to side wall panels 23 proximal to the upper groove 75 as shown in FIGS. 17A and 17B for a locked position and an unlocked position respectively. When in a locked position, the cam lock prevents upward displacement of a side wall panel 23 within section 190*b* by reducing the vertical dimension of section 190*b*. FIG. 17C is a sectional view of the container which shows that when the cam lock is in a locked position it reduces the vertical space available in groove 75 at section 190*b*. Reducing the vertical dimension of section 190*b* provides a snug fit of side wall panel 23 between the roof 5 and base 10. Section 190*b* is dimensioned to loosely engage the side wall panel 23 when the cam lock is in an open position so as to allow removal of side wall panel 23 from the container. Side wall panels 23 are generally removed by lifting the panel vertically to unseat the lower tongue and groove means, followed by outward displacement of the panel.

A combination of dead bolts and cam disk locks can also be used to prevent upward displacement of one or more side wall panels, as can other locking means that are well known in the art.

In an embodiment of the current invention, the end skirting walls of the roof have downwardly extending flanges 200 which overhang the end walls when the container is erect. In an embodiment the flanges 200 seal the ends of a collapsed container by a mating or abutting engagement with the retaining walls of the base. In an embodiment, the retaining walls 100 have a lip 205 that engages the flanges 200 on the roof when the container is collapsed. The flanges 200 help to waterproof the container 1.

In order to facilitate movement of container 1, the base may have cut outs 210 which accommodate a pair of tines or prongs approaching the container along an axis substantially perpendicular to the side walls or substantially perpendicular to the end walls (see FIGS. 5A and 5B). The cut outs 210 form depending tine slots and can be integrally molded in base 10 with spacing to accommodate the tines of a forklift, a hand push pallet mover or hand jack or other suitable device having tines which engage complimentary slots. A person skilled in the art will recognize that several configurations of cuts outs 210, with varying dimensions, would be possible for use with the current invention, so long as a pair of forklift tines can be accommodated from at least one direction perpendicular to either the end walls or the side walls. The cut outs 210 are distinct from the wells 110 in that they open the base end walls or the base side walls to receive a set of tines. In contrast the wells 110 are inside the perimeter edges of the base and do not receive tines.

The roof can have protrusions 215 which are complimentary to the cut outs 210 and the wells 110 in the base, so that a plurality of collapsed or erect containers may be stacked one on top of the other without slippage (see FIG. 4A). Optionally, a gully 220 can be provided in the protrusions 215 of roof 5 to allow liquid to escape a confined area 225 defined in the roof by the protrusions.

Figure 7A:
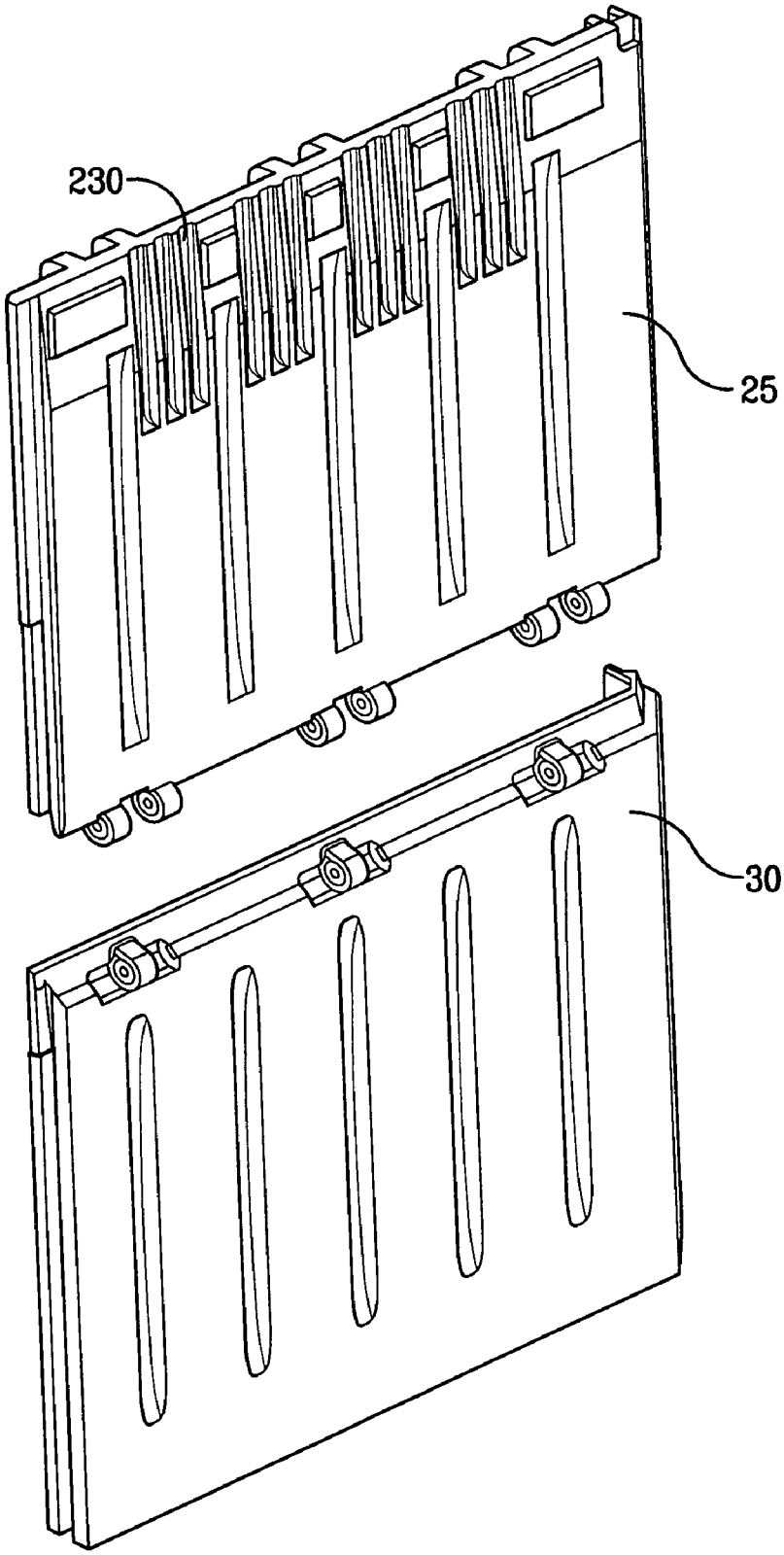
FIG. 7A shows a front exploded perspective view of an end wall in an embodiment of the invention.
Figure 7B:
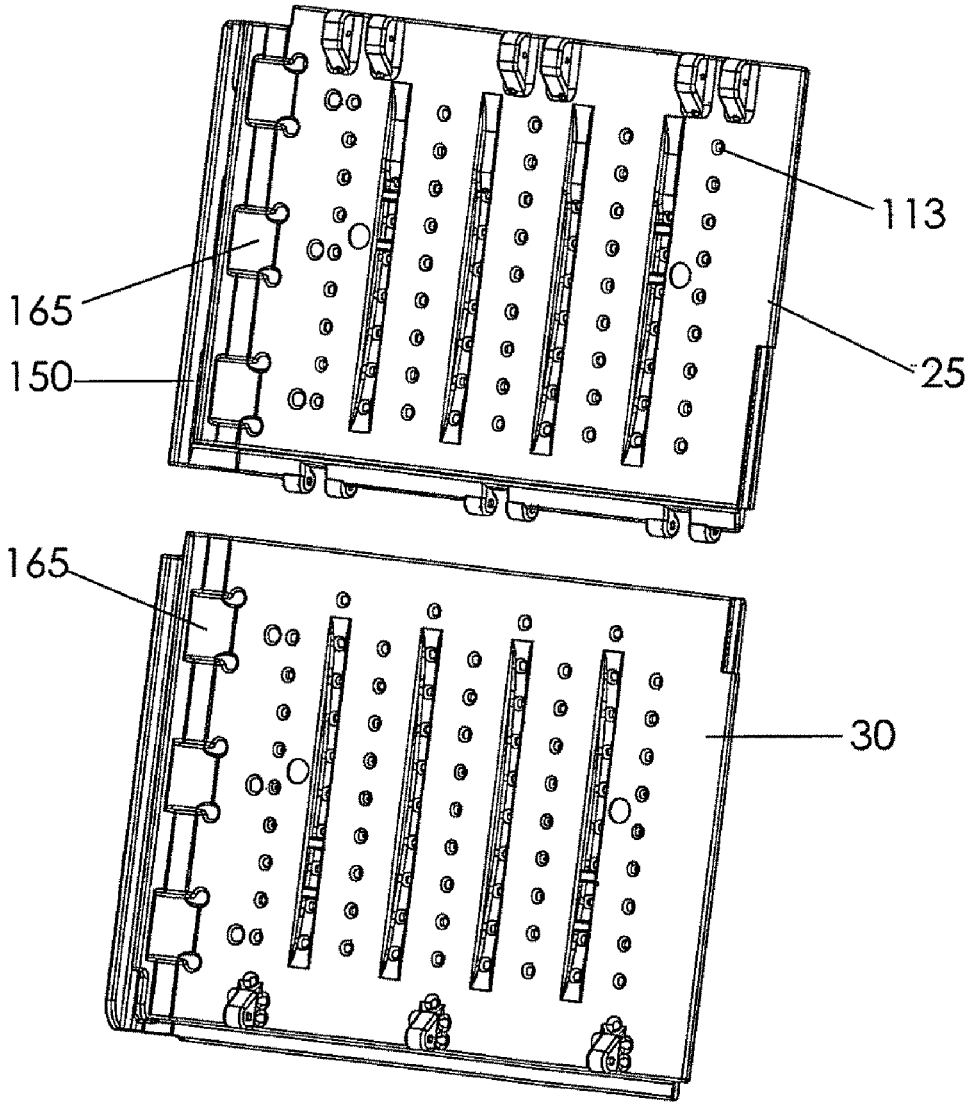
FIG. 7B shows a rear exploded perspective view of an end wall in an embodiment of the invention.

In an embodiment of the invention, at least one of the end walls has a plurality of rain proof cutouts 230 comprising vertical troughs which extend from an upper end of the end wall 15 to below the bottom edge of the downwardly extending flanges 200 (see FIGS. 1A and 7A). The troughs provide airflow into erect container 1 while the shape of cutouts 230 prevents water from entering the container 1.

In an embodiment, the top surface 80 of the base 10 immediately inward of lower groove 105 is vertically higher than the top surface 80 of the base 10 immediately outward of lower groove 105 so that liquid entering the lower groove 105 will not flow into the container 1.

Optionally, the lower grooves 105 may contain drainage holes.

The side wall panels 21-23 and the end wall panels can have one or more than one handle.

The hinges 40, 41 and 42 can be made of rotomolded plastic. The hinges 40, 41 and 42 have male and female components that can be optionally integrally molded with the upper and lower end wall panels, the roof or the base. A person skilled in the art will know that a hinge will have a hinge pin which holds the male and female components together by threading through a common bore.

The incorporation of an insulating or structural material between the inner and outer wall members 45 and 50 respectively, of each twinned wall component is also contemplated by the current invention. By way of a non-limiting example, a foamed plastic or expandable cellular plastic may be used as an insulating material.

The base 10 can be reinforced by any method known in the art to strengthen plastic pallets, including for example the incorporation of metal, plastic or composite reinforcing bars, ribbing, columns, posts or studs.

The dimensions of the container are not of particular importance, however, by way of example only, the container can be 8 feet high by 8 feet wide by 6 feet deep. In another non-limiting embodiment the minimize size of the container will be 6 feet high by 4 feet wide by 6 feet deep.

The load bearing capacity of container 1 will depend on the dimensions of the container, but by way of example only, a container with the dimensions 8 feet high by 8 feet wide by 6 feet deep will have a load bearing capacity of up to about 8000 lbs.

The weight of an unloaded erect or collapsed container of the current invention will depend on the dimensions of the container, but by way of example only, the weight of a container 8 feet high by 8 feet wide by 6 feet deep, will be less than 2500 lbs, preferably from about 500 to 1500 lbs.

The container 1 can be moved using standard hand pushed pallet movers or hand jacks. A forklift, crane or other especially heavy equipment is not a requirement for moving the container 1, although they may also be used.

To collapse the container the side wall panels are removed, followed by inward folding of each end wall along horizontal axes 35, to draw the roof 5 closer to the base 10. To permit inward folding of the end walls one or more slide locks must be set to an open position as shown in FIG. 8B. Optionally, and depending on the container dimensions, the side wall panels can be placed in the recessed area between the upwardly extending end retaining walls 100 on the top surface 80 of the base 10 before the container is collapsed. This allows the side wall panels to be stored within the collapsed container.

To erect the container, the above steps are reversed: the roof 5 is lifted away from the base 10, causing the end walls 15 to fold outward until they are substantially vertical. When the end walls are substantially vertical, one or more slide locks can be moved from an open position to a locked position as shown in FIG. 8C. Next, the side wall panels are fed through a section in each upper groove 75, which is dimensioned to loosely engage a side wall panel, in order to engage the tongue and groove means. Optionally, only side wall panels of the type having an L-shaped cross section (i.e. side wall panels 23) are added to the container in order to leave openings for access to the interior of an erected container. Optionally, side wall panels having a generally flat shape (i.e. side wall panels 21 and 22) are also added to partially close or fully close the container.

Figure 18:
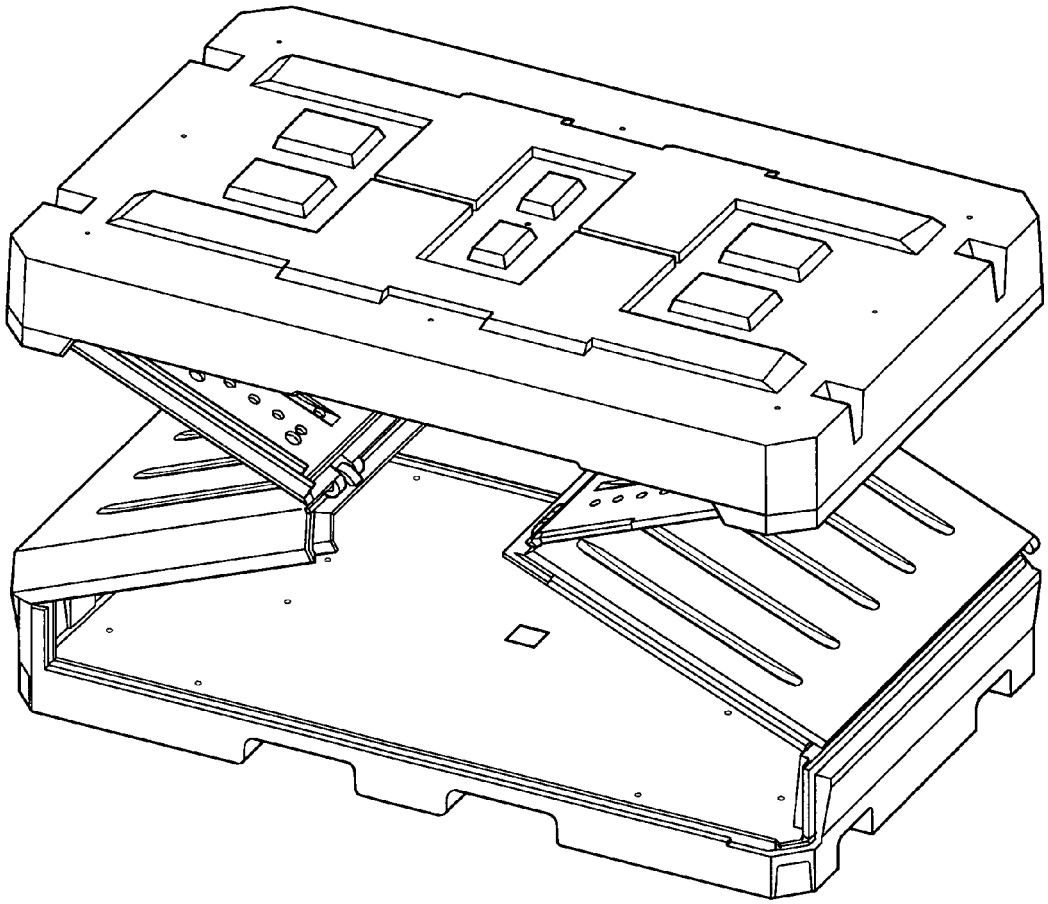
FIG. 18 shows a perspective view of an embodiment of the current invention.
Figure 19:
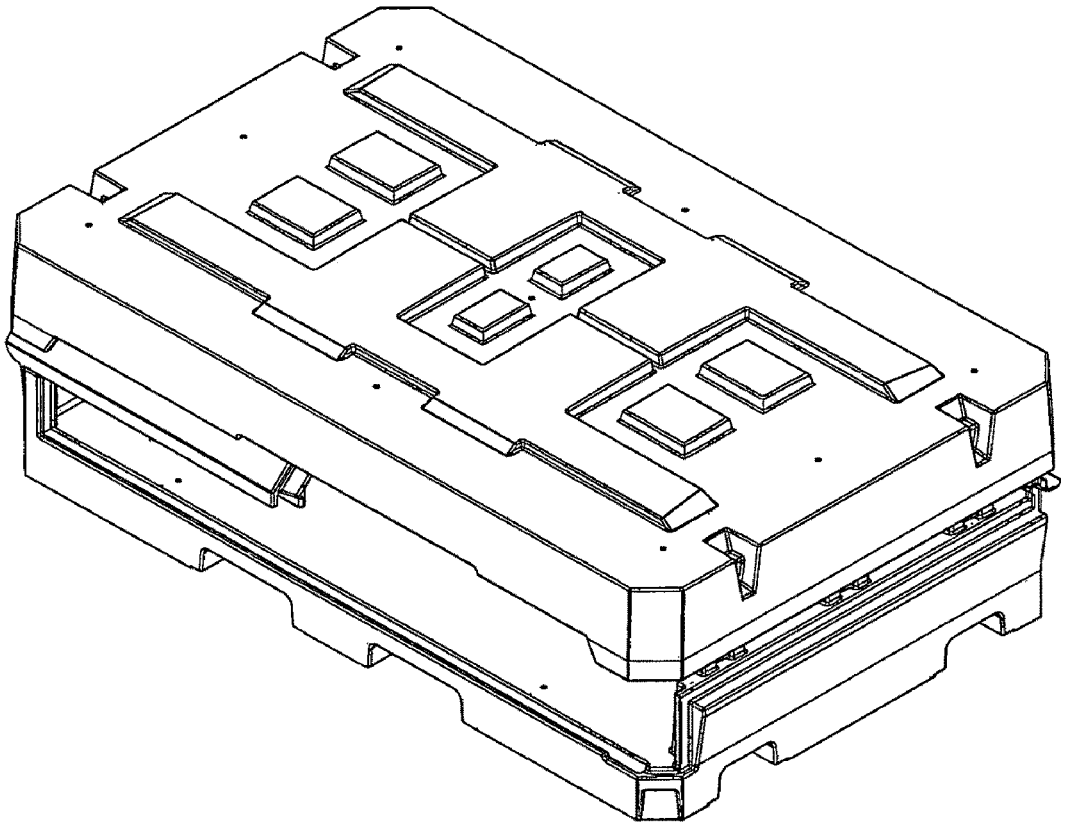
FIG. 19 shows a perspective view of an embodiment of the current invention.

In an embodiment of the invention the container is collapsed in the following manner: side wall panels 22 and 21 are removed by sequential alignment with section 190*a* and disengagement of the tongue and groove means by upward displacement. This requires the unlocking of any locking means (e.g. dead bolts or cam locks) holding panels 21 and 22 in place. To remove the side wall panels 23, cam lock 195 is turned to the open position and side wall panels 23 which are aligned with section 190*b* are disengaged from the tongue and groove means. Next, to permit inward folding of the end walls, one or more slide locks are set to an open position as shown in FIG. 8B. Inward folding of each end wall along horizontal axes 35 draws the roof 5 closer to the base 10. A partially collapsed container is shown in FIG. 18. The fully collapsed state of container 1 is shown in FIG. 19. Optionally, and depending on the container dimensions, the side wall panels can be placed in the recessed area between the upwardly extending end retaining walls 100 on the top surface 80 of the base 10 before the container is collapsed.

In an embodiment of the invention the container is erected in the following manner: the roof 5 is lifted away from the base 10, causing the end walls 15 to fold outward until they are substantially vertical. When the end walls are substantially vertical, one or more slide locks can be moved from an open position to a locked position as shown in FIG. 8C. Next, side wall panels of the type having an L-shaped cross section (i.e. side wall panels 23) are added to the container. Each side wall panel 23 is added by alignment with section 190*b* to engage the roof, base and end wall. The cam lock 195 is then turned to the locked position. Optionally, one or more side wall panels having a generally flat shape (i.e. side wall panels 21 and 22) are also added to partially close or fully close the container. The side wall panels 21 are added by alignment with section 190*a* to engage the roof and base and then slid over to engage the end wall. Side wall panels 22 are added by alignment with section 190*a* to engage the roof, the base and adjacent side walls panels. If present, any locking means (e.g. dead bolts or cam locks) holding panels 21 and 22 (and 23) in place can be set to the locked position. Also, when optional guide pins 175 and receiver slots 180 are incorporated into side wall panels, 21, 22, and 23 the guide pin of one side wall panel will be fully seated within the receiver slot of an adjacent side wall panel, when the side walls panels have been properly installed between the roof and the base.

The roof 5 can be lifted manually, with a forklift, a jack or other suitable means. For example, a forklift can be used to erect the end walls, followed by locking the slide lock and/or the addition of at least one side wall panel to maintain the container in an erected position. The roof, 5 can also contain "I" bolts and recesses 235 to receive them as shown in FIG. 4A, or foldable hooks or latches or any other means by which the roof can be gripped from above for purposes of erecting the container by crane, forklift, jack and the like. The method used by a person skilled in the art to erect the container will depend on the dimensions and weight of the container.

Figure 20A:
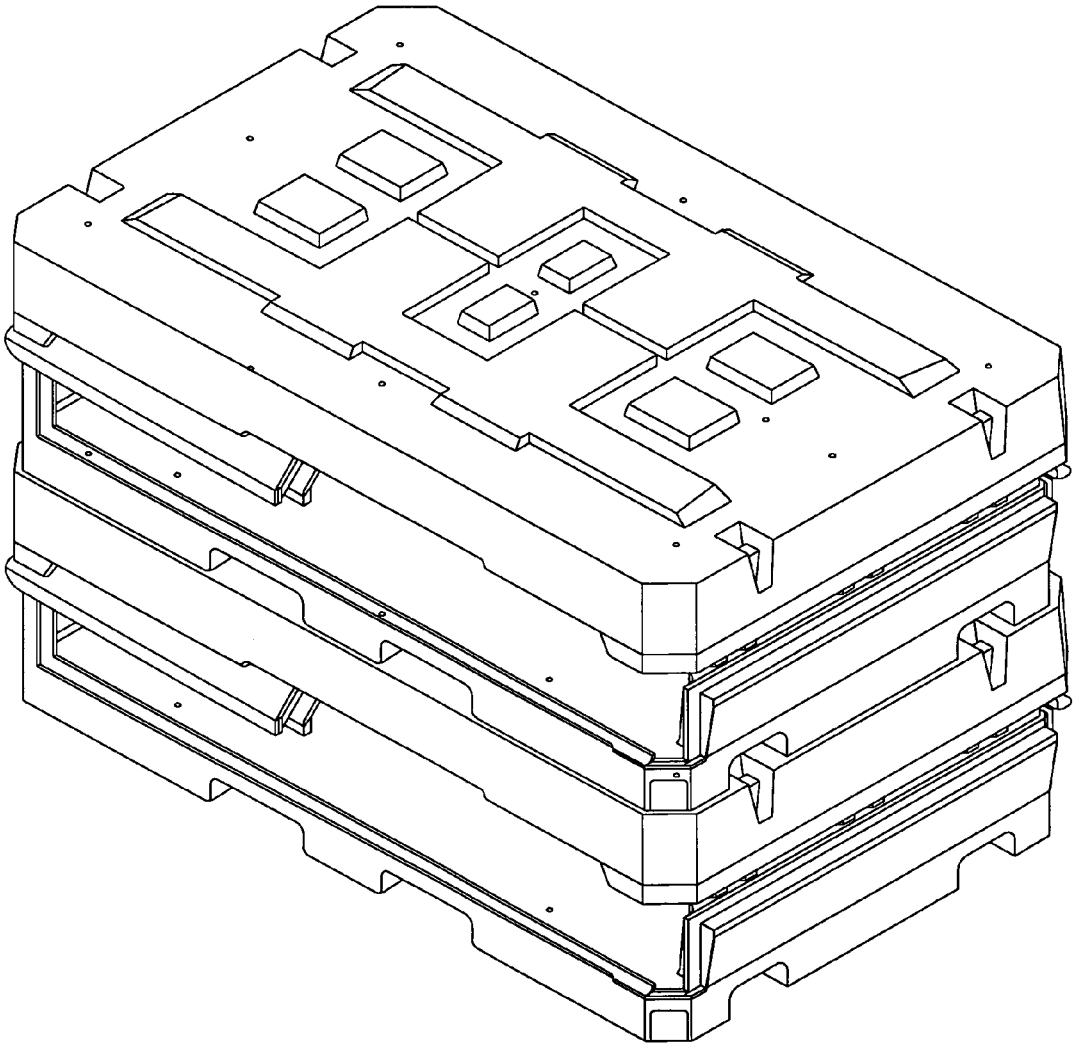
FIG. 20A shows a perspective view of an embodiment of the current invention.

With reference to FIG. 20A, stacked containers in a collapsed position are shown.

The container of the present invention may also be fitted with a cargo tie down means. The cargo tie down means comprises any suitable method for securely fastening the contents of the container to an inner surface of the container. For example, straps which are fixed to an inside surface of the end walls, side walls, or base may be used. One or more restraints may be incorporated within the container.

It will be recognized by persons skilled in the art, that the above description represents specific embodiments and that various modifications can be made without diverging from the scope of the invention described.

What is claimed is:

1. A collapsible container comprising:

a roof;

a base;

two opposing end walls, each end wall comprising an upper and a lower end wall panel pivotally attached to said roof and said base respectively, said upper end wall panel being horizontally pivotally attached to said lower end wall panel to permit inward folding of each of said end walls;

two opposing removable side walls fitting between said roof and said base;

at least one slide lock;

each slide lock riding along common lateral edges of said upper and lower end wall panels, wherein said slide lock prevents the inward folding of an end wall when in a locked position by traversing the horizontal axis about which the upper and lower end wall panels are pivotally attached to one another and allows the inward folding of an end wall when in an unlocked position by residing entirely within the upper end wall panel or entirely within the lower end wall panel;

said end walls and said side walls being a twinned wall structure defined by inner and outer wall members made of plastic;

wherein at least one of said side walls and said end walls has a plurality of elongated concave indentations, each concave indentation independently forming a substantially vertical internal arch between said inner and outer wall members, said arch being arcuately shaped and spanning the length of said concave indentation;

whereby said container is collapsible by removing said side walls and, with each slide lock in said unlocked position, inwardly folding said end walls to draw said roof closer to said base.

2. The container of claim 1, wherein each of said side walls is partitioned into at least two removable side wall panels.

3. The container of claim 2, wherein each of said side wall panels engage said roof and said base by complimentary upper and lower tongue and groove means respectively.

4. The container of claim 3, wherein each of said side walls comprise first, second and third sequentially adjacent side wall panels.

5. The container of claim 4, wherein each upper tongue and groove means has one or more sections dimensioned to loosely engage said first, second and third side wall panels, so that said first, second and third side wall panels can be removed from said container when aligned with said one or more sections.

6. The container of claim 5, further comprising a locking means which prevents removal of said first, second or third side wall panels when aligned with said one or more sections.

7. The container of claim 6, wherein said upper end wall panels are pivotally attached to end skirting walls extending downwardly from said roof.

8. The container of claim 7, wherein said lower end wall panels are pivotally attached to end retaining walls extending upwardly from said base.

9. The container of claim 8, wherein said end walls, said end retaining walls and said side walls have, along one lateral edge, a corner extension.

10. The container of claim 9, wherein said corner extension on said end walls and said end retaining walls engage an adjacent edge of said side walls by a vertical tongue and groove means, and wherein said corner extensions on said side walls engage an adjacent edge of said end walls and said end retaining walls by a vertical tongue and groove means.

11. The container of claim 10, wherein said third side wall panel in each side wall has attached to an upper edge, a rotatable cam lock, said cam lock allowing or preventing removal of said third side wall panels from said container.

12. The container of claim 11, wherein said base has depending tine slots.

13. The container of claim 12, wherein said roof has protrusions complimentary to said tine slots so that a plurality of containers can be stacked one on top of the other without slippage.

14. The container of claim 13, wherein said side walls and said end walls are rotomolded plastic components.

* * * * *